US010358693B2

(12) United States Patent
Sokhanvaran et al.

(10) Patent No.: US 10,358,693 B2
(45) Date of Patent: Jul. 23, 2019

(54) METHOD OF DIRECT REDUCTION OF CHROMITE WITH CRYOLITE ADDITIVE

(71) Applicant: Her Majesty the Queen in Right of Canada, as represented by the Minister of Natural Resources, Ottawa (CA)

(72) Inventors: Samira Sokhanvaran, Ottawa (CA); Dogan Paktunc, Ottawa (CA)

(73) Assignee: HER MAJESTY THE QUEEN IN RIGHT OF CANADA, AS REPRESENTED BY THE MINISTER OF NATURAL RESOURCES, Ottawa (CA)

( * ) Notice: Subject to any disclaimer, the term of this patent is extended or adjusted under 35 U.S.C. 154(b) by 0 days.

(21) Appl. No.: 15/788,953

(22) Filed: Oct. 20, 2017

(65) Prior Publication Data

US 2019/0119784 A1 Apr. 25, 2019

(51) Int. Cl.

| | |
|---|---|
| ***C22B 5/10*** | (2006.01) |
| ***C21B 13/00*** | (2006.01) |
| ***C22B 34/32*** | (2006.01) |

(52) U.S. Cl.

CPC ..... *C22B 34/32* (2013.01); *C21B 13/008* (2013.01); *C22B 5/10* (2013.01)

(58) Field of Classification Search

CPC .. C22B 5/02; C22B 34/32; C22C 1/02; C21B 13/0033; C21B 13/004; C21B 13/0046; C21B 13/006; C21B 13/008

See application file for complete search history.

(56) References Cited

U.S. PATENT DOCUMENTS

| | | | | |
|---|---|---|---|---|
| 869,681 | A | 10/1907 | Annable | |
| 1,871,723 | A | 8/1932 | Morrow | |
| 2,049,081 | A | 7/1936 | Saltrick | |
| 2,398,591 | A | 4/1946 | Mitchell | |
| 2,991,159 | A * | 7/1961 | Wendt | C01F 7/54 423/116 |
| 4,629,506 | A | 12/1986 | Ulrich et al. | |

(Continued)

FOREIGN PATENT DOCUMENTS

| | | | |
|---|---|---|---|
| WO | 2012149635 | A1 | 11/2012 |
| WO | WO 2013011521 | A1 * | 1/2013 |

(Continued)

OTHER PUBLICATIONS

Atasoy, A. & F. R. Sale. "An Investigation on the Solid State Reduction of Chromite Concentrate." Solid State Phenomena. vols. 147-149 pp. 752-757. (Year: 2009).*

(Continued)

*Primary Examiner* — Tima M McGuthry-Banks
(74) *Attorney, Agent, or Firm* — Brion Raffoul

(57) ABSTRACT

A method of chromite reduction using cryolite ($Na_3AlF_6$) as an additive. The cryolite used may be pure cryolite or an impure mixture containing cryolite, such as the bath material produced as waste or as a by-product of aluminum smelting processes. In one embodiment, the reduction product is re-melted at a higher temperature to form larger metallic particles. In another embodiment, the chromite ore is granulated with cryolite particles and carbon reductant particles before being reduced.

28 Claims, 23 Drawing Sheets

(56) References Cited

U.S. PATENT DOCUMENTS

| | | | |
|---|---|---|---|
| 5,302,184 | A | 4/1994 | Batterham et al. |
| 9,376,733 | B1 | 6/2016 | Freeman |
| 2014/0060251 | A1 | 3/2014 | Lu |
| 2016/0237526 | A1 | 8/2016 | Winter |
| 2016/0244864 | A1 | 8/2016 | Winter |

FOREIGN PATENT DOCUMENTS

| | | | |
|---|---|---|---|
| WO | 2015015250 | A1 | 2/2015 |
| WO | 2015060951 | A1 | 4/2015 |
| WO | 2015061249 | A1 | 4/2015 |
| ZA | 8705774 | B | 4/1988 |

OTHER PUBLICATIONS

Xia, Y., C. Schuffeneger, M. Reuter, L. Holappa, & T. Seppala. "Solid State Reduction of Chromite with CO." Proceedings: Tenth International Ferroalloys Congress; INFACON X: "Transformation through Technology." pp. 26-35. (Year: 2004).*

Kapure, G. U., C. B. Rao, V. D. Tathavadkar, & R. Sen. "Direct Reduction of Low Grade Chromite Overburden for Recovery of Metals." Ironmaking and Steelmaking. vol. 38, No. 8. pp. 590-596. (Year: 2011).*

Rowe, J. "Stainless Steel in Figures 2015." International Stainless Steel Forum (ISSF), Brussels, Belgium. 2015.

Hjartarson, J., Beneath the Surface: Uncovering the Economic Potential of Ontario's Ring of Fire. Ontario Chamber of Commerce, 2014.

Kelly, T., Historical statistics for mineral and material commodities in the United States. No. 140. US Geological Survey, 2005.

Goel, R. P., "Smelting technologies for ferrochromium production-recent trends." (1997): 37-50.

Ugwuegbu, C., "Technology innovations in the smelting of chromite ore." Innovative Systems Design and Engineering 3.12 (2012): 48-5.

Naiker, O., "The development and advantages of Xstrata's Premus Process." Proceedings Ferroalloys 11 th International congress. 2007.

Discover Chromium "Ore Processing" International Chromium Development Association. 2011.

Cramer, M., "Report: Review and Analysis of International Experiences in Chromite Mining and Ferrochrome Production, and Implications for the Development of Canadian Deposits" Natural Resources Canada, R&D Gap Analysis for the Development of the Ring of Fire, 2016.

Niayesh, M.J., "The solid-state reduction of chromite." INFACON 6. 1 (1992): 57-63.

Dawson, N.F., "Factors affecting the reduction of chromite." Proceedings of INFACON IV 4th International Ferro Alloys Congress. 1986.

Neizel, B.W., "Why is CaCO3 not used as an additive in the pelletised chromite pre-reduction process?." Minerals Engineering 45 (2013): 115-120.

Van Deventer, J.S.J., "The effect of additives on the reduction of chromite by graphite: An isothermal kinetic study." Thermochimica Acta 127 (1988): 25-35.

Murti, N. S., "Effect of lime addition on rate of reduction of chromite by graphite." Trans. Inst. Min. Metall. C 92 (1983).

Ding, Y.L., "Catalytic reduction of carbon-chromite composite pellets by lime." Thermochimica Acta 292.1-2 (1997): 85-94.

Ding, Y.L., "Reduction of carbon-chromite composite pellets with silica flux." Ironmaking & steelmaking 24.4 (1997): 283-287.

Lekatou, A., "Effect of SiO2 addition on solid state reduction of chromite concentrate." Ironmaking and Steelmaking 24.2 (1997): 133-143.

Weber, P., "The reduction of chromite in the presence of silica flux." Minerals Engineering 19.3 (2006): 318-324.

Wang, Y., "Effects of CaO, MgO, Al2O3 and SiO2 on the Carbothermic Reduction of Synthetic FeCr2O4." Journal of Mining and Metallurgy. Section B: Metallurgy 51.1 (2015): 17.

Neuschutz, D., "Effect of flux additions on the kinetics of chromite ore reduction with carbon." Proc. Int. Ferroalloy Cong., Trondheim, Norway (1995): 371-380.

Bisaka, K., Solid-State Reduction of South African Manganese and Chromite Ores: Effect of an Organic Binder and B2O3, Proceedings of the XXVIII International Mineral Processing Congress. 2016.

Menzies, I.A., "The Chromium-Cryolite Chromizing Process" "The Chromium-Cryolite Chromizing Process." Transactions of the IMF 42.1 (1964): 258-267. Obtained from: http://www.tandfonline.com/doi/abs/10.1080/00202967.1964.11869933?journalCode=ytim20.

Katayama, H.G., "Promotion of the carbothermic reduction of chromium ore by the addition of borates." Tetsu-to-Hagané 72.10 (1986): 1513-1520.

Nunnington, R.C., "Pre-reduction of fluxed chromite-ore pellets under oxidizing conditions." Mintek, 1989.

Takano, C. et al., "Chromites reduction reaction mechanisms in carbon—chromites composite agglomerates at 1773 K." ISIJ international 47.11 (2007): 1585-1589.

CLarke, F. W., "Art. XIX.—Contributions to Chemistry from the Laboratory of the Lawrence Scientific School—No. 5. On a new process in Mineral Analysis." American Journal of Science and Arts (1820-1879) 45.134 (1868): 173.

ISA/CA, International Search Report and Written Opinion for corresponding PCT International Patent Application No. PCT/CA2017/051252 dated Jul. 11, 2018.

* cited by examiner

METHOD OF DIRECT REDUCTION OF CHROMITE WITH CRYOLITE ADDITIVE

TECHNICAL FIELD

The present invention relates to chromite reduction.

BACKGROUND

Chromium (Cr) is an industrially important element, necessary for chrome plating and the production of stainless steel. The only source of metallic chromium that exists is chromite ore ($Cr_2O_3$), which commonly occurs as chromite ($FeCr_2O_4$) where iron in the formula can be substituted by magnesium and chromium by both aluminum and ferric iron. Ferrochrome smelting using conventional carbothermic methods is an energy-intensive process, requiring energy inputs up to 4.6 MWh for each tonne of ferrochrome produced.

"Prereduction" (direct reduction of the chromite ore before smelting) can allow reduction and metallization to occur at lower temperatures, thus requiring less energy. In this context, "reduction" and "prereduction" refer to a chemical process wherein oxygen is removed from one reactant (here, the chromite ore) and taken up by another reactant (referred to as the "reductant"). Hence, the oxidation states of the constituents of one reactant (the chromite here) is "reduced".

Although prereduction enables lower temperatures, the process occurs in solid-state (meaning that both the chromite ore and the reductant are in solid form). Solid-state reactions are kinetically slow and rarely result in completely metallized chromite ore. The greater the metallization during prereduction, the lower the energy requirements can be, and the greater the energy savings.

Additionally, low ash coke, the most common reductant source in the smelting process, is expensive in itself. A method that increases metallization before smelting without requiring a high quality reductant would be more cost-effective than traditional smelting processes.

It is common to add fluxing agents to the reduction furnace, to improve the metallization rate. These fluxing agents enhance the formation of a liquid slag layer in the chromite ore and allow greater metallization at lower temperatures. Several kinds of fluxing agent have been considered in the prior art, including alkali salts, borates, carbonates and silicates. Addition of these fluxes decreases the melting temperature of refractory oxides namely, MgO and $Al_2O_3$. This has enabled chromite reduction to occur effectively even at temperatures under 1400° C. (as compared to reduction temperatures of up to 2000° C. for smelting).

However, not all of these fluxes are easily available. They may be expensive, uncommon, or both. Thus, there would be a benefit to the use of an additive that is not only useful, but also widely available and cost-effective. Preferably, such an additive would allow for chromite reduction at even lower temperatures.

SUMMARY

The present invention provides a method of chromite reduction using cryolite ($Na_3AlF_6$) as an additive. The additive used may be pure cryolite or an impure mixture containing cryolite, such as the bath material produced as waste or as a by-product of aluminum smelting processes. Unlike regular fluxing agents that enhance the slag (oxide based liquid phase) forming process, cryolite unlocks the complex oxide structure by selectively dissolving various oxides from the chromite/spinel. Cryolite is known to be a corrosive salt in molten form that selectively dissolves the refractory components (MgO and $Al_2O_3$). The molten cryolite layer acts as a transport medium for Cr and Fe species.

In one embodiment, the reduction product is melted at a higher heat after reduction, to form larger metallic particles. In another embodiment, the chromite ore is granulated with cryolite particles and carbon reductant particles before being reduced.

The present invention provides a method of reducing chromite ore comprising the steps of:

(a) reducing a mixture in a furnace to form a reduction product;

(b) separating said reduction product into a metallic chromium alloy phase and a non-metallic phase, wherein said mixture is a mixture of chromite ore particles, reductant particles, and cryolite additive particles.

In another aspect, the present invention provides a method for direct reduction of chromite, the method including the steps of:

(a) reducing a mixture to form a solid reduction product;

(b) separating the solid reduction product into a metallic chromium alloy phase and a non-metallic phase, wherein the mixture includes a mixture of chromite particles, reductant particles, and a transport media, the transport media being cryolite particles.

In yet another aspect, the present invention provides a method for direct reduction of chromite, the method including the steps of:

(a) mixing chromite particles, reductant particles, and a transport media, the transport media being cryolite particles, to form a mixture;

(b) reducing the mixture to form a solid reduction product;

(c) cooling the solid reduction product; and (d) separating the solid reduction product into a metallic chromium alloy phase and a non-metallic phase.

In a further aspect, the present invention provides a method for direct reduction of chromite, the method including the steps of:

(a) obtaining chromite particles;

(b) obtaining reductant particles;

(c) obtaining cryolite particles;

(d) mixing the chromite particles, the reductant particles, and the cryolite particles to form a mixture;

(e) reducing the mixture at a predetermined temperature for a predetermined time to form a solid reduction product;

(f) cooling the solid reduction product; and (g) separating the solid reduction product into a metallic chromium alloy phase and a non-metallic phase, wherein steps (a) to (c) may be performed in any order.

BRIEF DESCRIPTION OF THE DRAWINGS

The present invention will now be described by reference to the following figures, in which identical reference numerals refer to identical elements and in which.

DETAILED DESCRIPTION

In one embodiment of the invention, chromite direct reduction is accomplished using cryolite as an additive. Since chromite reduction using cryolite is a broad process with many potential embodiments, there are a number of alternatives to practicing the various embodiments and implementations of the invention, including, for instance, varying the source particle size.

Figure 1:
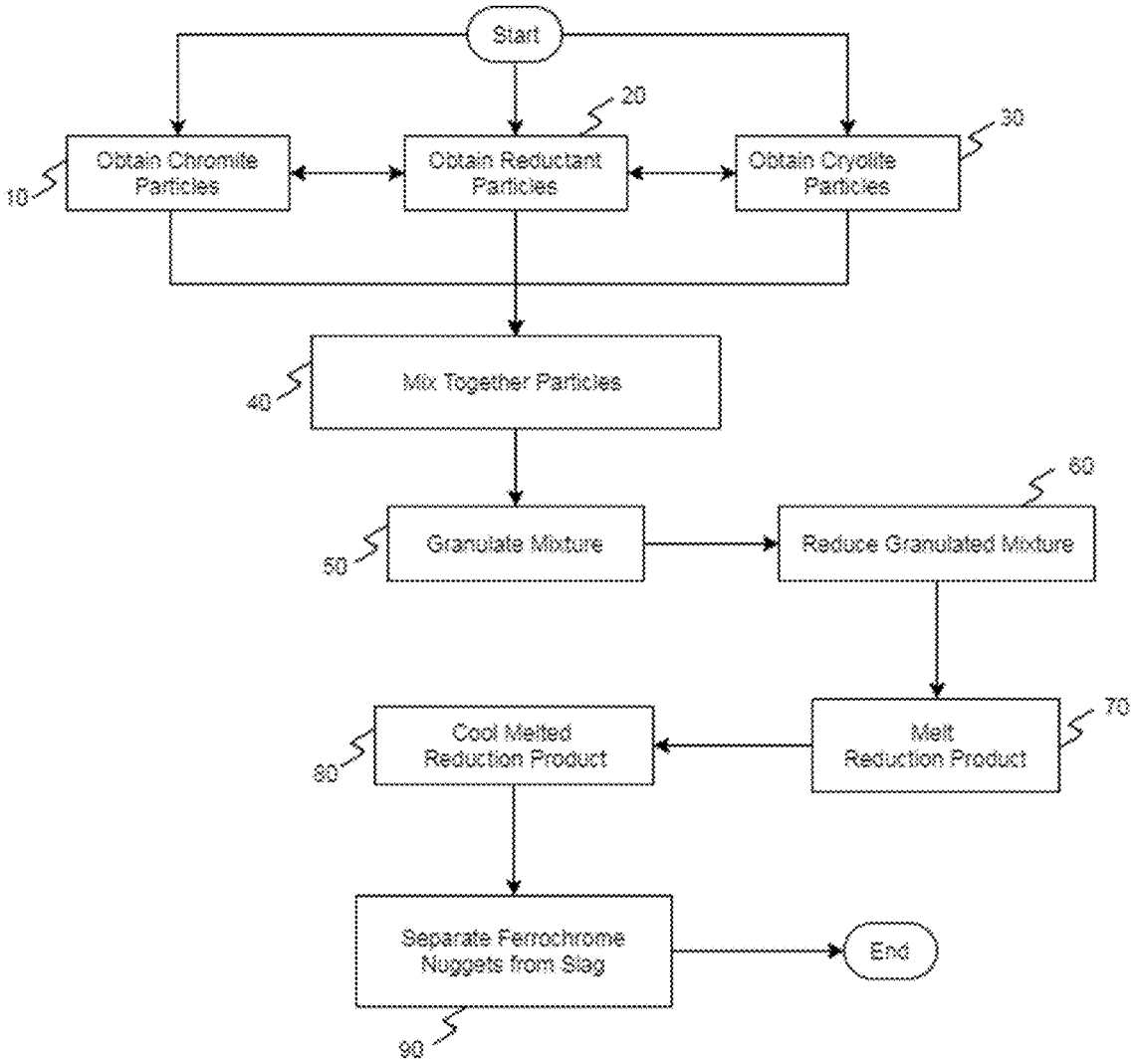
FIG. 1 is a flowchart detailing the steps in a method according to one embodiment of the invention.

One embodiment of the invention is shown in FIG. 1. FIG. 1 is a flowchart showing the steps of a method according to one embodiment of the invention where chromite is reduced using cryolite as an additive. First, at step 10, a usable particle form of the chromite ore is obtained. This is commonly accomplished by grinding a chromite ore source to the desired size. At step 20, similarly, particles of reductant are obtained. Likewise, at step 30, particles of cryolite are obtained.

In step 40, all three kinds of particles are mixed together. Then, in step 50, a granulating unit creates pellets or briquettes out of the mixture. Next, in step 60, the pellets or briquettes are reduced in a furnace, to form a reduction product. The reduction product is then quickly melted at a higher temperature than the temperature of reduction (step 70) to increase the size of ferrochromium nuggets produced. In step 80, the melted reduction product is cooled, and then at step 90, the ferrochromium nuggets are separated from the non-metallic phase.

With reference to steps 10, 20, and 30, the kinetics of reduction mean that certain particle sizes react more efficiently than others. Thus, these grinding steps are calibrated to result in specific sizes of particle. In the case of the chromite ore, the optimal particle diameter is between 53 μm and 74 μm, inclusive. However, for practicality, some of the chromite ore particles may be as large as 150 μm. (Note that all ranges used herein should be considered to be inclusive of their end values, unless explicitly noted otherwise.) Optimal reductant particle diameter is between 38 μm and 106 μm, though some of the reductant particles may have diameters of up to 150 μm. While cryolite particles that are less than 106 μm in diameter (preferably less than 63 μm in diameter) have been found to work with the invention, it should be noted that individual cryolite particle size is not as important as the cryolite powder being fine enough to mix well with the other powdered material. The cryolite particle size should thus be such that the cryolite mixes well with the other powders.

Additionally, the chromite does not need to be raw ore. Chromite fines, chromite concentrates or chromite wastes (for instance, chromite-containing slags from other ferrochrome processes or oxides from flue dusts) may be used instead of raw chromite ore. The reductant (again, the reactant that takes up oxygen removed from the chromite) is generally a widely-available carbon source such as low-ash coke, graphite or coal.

Moreover, although it is common to grind the chromite, reductant, and cryolite individually and in-house, it should be clear that particles of the desired sizes can be obtained in any manner (e.g., purchased from external vendors), without altering the effect of the invention.

The cryolite additive may be comprised of pure cryolite; however, naturally occurring cryolite is rare and commercially extinct. Pure synthetic cryolite (synthetic sodium aluminum fluoride) can be used as a substitute, but impure mixtures containing cryolite can also be used as the additive.

In one embodiment of the invention, the cryolite additive is an impure waste or by-product of aluminium smelting, known as "bath material". This bath material is widely available and comprises cryolite and various other compounds, primarily aluminum fluoride ($AlF_3$). Cryolite ($Na_3AlF_6$) can be considered a combination of sodium fluoride (NaF) and aluminum fluoride; thus, a well-known measure called the "cryolite ratio" represents the relative proportions of sodium fluoride and aluminum fluoride in bath material. This measure can be calculated using the formula in equation (1):

$$\text{Cryolite Ratio} = \frac{\text{moles of NaF}}{\text{moles of } AlF_3} \quad (1)$$

Bath material is an impure source of cryolite that is off from the stoichiometry value (molar ration $NaF/AlF_3=3$). NaF tends to evaporate from this material and bath ends up having excess $AlF_3$. Bath material also contains dissolved alumina and $CaF_2$ as impurities. $AlF_3$ and $Al_2O_3$ both have a negative effect on the effectiveness of bath material as a source of cryolite for direct reduction. However, bath material containing up to 11 wt % excess $AlF_3$ and 8% dissolved $Al_2O_3$ has been found to be acceptable. The cryolite ratio (equation 1) should be between 1 and 7, encompassing the typical variation of bath material produced during aluminum smelting. Specific impurities in bath material, such as $CaF_2$ (6 wt % of excess of $CaF_2$), have been found to have a positive effect on reduction.

The use of bath material as the source of the cryolite additive provides several benefits. Not only is bath material widely available, it is also cost-effective. Moreover, there is an environmental benefit, as using bath material in chromite reduction recycles this hazardous waste product and extends its useful life before disposal.

It should be noted that, in step 40, when the particles are mixed together, the mixture is proportioned by weight, with the chromite source particles comprising the largest part of the mixture. The proportion of chromite to carbon to cryolite can vary between 100:15:15 and 100:25:30, depending on the desired application.

It should also be noted that the optional granulation step, step 50, may be implemented using a granulating unit. Such a granulating unit may take the form of, for example, a compression-molding machine, a disc or drum pelletizer, or an extruder. The granulating unit creates pellets or briquettes out of the mixture. The pellets or briquettes have the same chromite-carbon-cryolite ratio as the original mixture, and can have diameters as small as 1 cm and as large as 2 cm. Of course, this granulating step may be omitted and the powder mixture can be moved to the reduction step without further granulating the mixture.

For the chromite reduction step, step 60, many different kinds of furnaces may be used, including, for example, rotary kiln, rotary hearth, tunnel hearth, multiple hearth, and paired straight hearth. The reduction reaction, as governed by the furnace, may include multiple stages, including drying, preheating, reduction itself, and cooling. Depending on various factors, the furnace temperature can be as low as 1200° C. or as high as 1400° C.

Whatever furnace type and furnace temperature are used, the reduction process requires a reducing atmosphere. The reducing atmosphere is an atmospheric condition well known in the art, wherein the removal of oxidizing gases (including oxygen) prevents oxidation and encourages chromite reduction (the removal of oxygen from the chromite). Many materials and techniques to improve the reducing atmosphere are known in the field. If the furnace used for reduction lacks the capacity for built-in atmospheric adjustment, a carbonaceous atmosphere adjusting agent may be added to the furnace. Many carbonaceous materials may be used as the atmosphere adjusting agent, including, for example, coal, waste plastic, and biomass. The atmosphere adjusting agent may be placed under the feedstock (the pellets, briquettes, or non-granulated mixture) as a bed layer in the furnace, or it may be added on top of the feedstock to shelter the feedstock from further oxidation.

It should be clear that the reducing atmosphere can be achieved in the furnace by adjusting the air to fuel ratio of the burner or by purging air from the chamber. In case the controlled atmosphere is not an option for the furnace design, a carbonaceous adjusting atmosphere agent can be added to the mixture at the reduction stage to control the atmosphere in the vicinity of the mixture. This adjusting agent can vary from coal to waste plastic or biomass. This material can be used as a bed layer for the feedstock or this material can be used to cover the feedstock to protect it from further reduction.

Once the reduction step (step 60) is complete, the furnace contains the "reduction product": ferrochrome alloy nuggets and non-metallic phases (reduced chromite, salt and oxyflouride phases). If larger nuggets of ferrochrome are needed, the nugget size can be increased by quickly melting the reduction product at high temperatures (step 70). It should be clear that step 70 is optional and that the reduced product may be moved directly to the separation stage without any melting.

In the event that the melting step is implemented, the melting unit can be separate from the main reduction furnace or can be a section of the main reduction furnace that maintains a temperature between 1350° C. and 1700° C. Although the relatively high temperatures require more energy, the melting step does not take long: the residence time of melting can be only ten to thirty minutes. The short residence time at higher temperatures means that this process is still more efficient than conventional smelting processes.

Before the ferrochrome nuggets can be separated from the non-metallic phases, the reduction product must be substantially cooled (step 80) so that it solidifies. The cooling step cools the melted reduction product resulting from step 70 to a temperature below 500° C. This cooling also prevents unwanted oxidation of the reduction product.

After cooling, the reduction product is sent to a separation unit which separates the alloy nuggets from the non-metallic phases (step 90). The size of the nuggets may dictate whether a comminution stage is needed before separation or not. The differences in the specific gravities and magnetic properties of the ferrochrome and non-metallic phases mean that well-known physical separation techniques may be used. Such techniques include magnetic separation and/or gravity separation.

Note that steps 10 to 30 above may be performed in any order. Additionally, these steps may be performed simultaneously or at different times. Further, steps 10 to 30 may be performed in separate locations or the same location. Steps 10 to 30 may result in large batches of particles, small batches of particles, or any combination thereof.

Also, as noted above, granulation of the mixture is not a required step in the process. Depending on the intended application, and the type of reduction furnace to be used, step 50 may be omitted from the method. Likewise, as noted above, the melting step 70 is not a necessary step in the invention. Depending on the intended use of the alloy produced, step 70 may be omitted.

EXAMPLES

The following examples show the effects of varying different parameters of the invention, including the composition of the feedstock, the residence time during reduction, whether the mixture is granulated or not, and the diameter of the chromite and carbon source particles.

To ensure that the effects of each parameter could be seen in isolation, other parameters were kept constant in testing. A small-scale horizontal tube furnace, purged with argon gas at a flow rate of 200 ml per minute, held an alumina crucible containing the feedstock. The furnace was heated to 1300° C. The evolution of the furnace atmosphere ("evolved gas") and the temperature of the feedstock were continuously measured during each test.

Tables 1 to 3 below show the chemical composition of the source components. Two sets of chromite ore particles were tested, one set having particle diameters between 75 μm and 106 μm, and the other having particle diameters between 53 μm and 74 μm. The composition of the chromite particles is shown in Table 1.

Table 2 shows the composition of the carbon reductant source (graphite, almost entirely carbon but with some impurities). Table 3 shows the composition of the three different cryolite sources that were examined: synthetic cryolite with a cryolite ratio of 3; a batch of bath material with a cryolite ratio of 2.2; and a batch of bath material with a cryolite ratio of 2.3. In each test, the cryolite source was ground into particles having diameters under 63 μm.

TABLE 1

Chromite Ore Composition (wt %).

| Chromite ore | $Cr_2O_3$ | $Fe_2O_3$ | Cr/Fe | $Al_2O_3$ | $SiO_2$ | MgO | $TiO_2$ | NiO | MnO | CaO |
|---|---|---|---|---|---|---|---|---|---|---|
| 75 μm-106 μm | 43.40 | 21.22 | 2.0 | 12.98 | 5.45 | 14.19 | 0.33 | 0.18 | 0.22 | 0.10 |
| 53 μm-74 μm | 38.20 | 18.83 | 2.0 | 12.26 | 8.37 | 16.89 | 0.30 | 0.32 | 0.19 | 0.14 |

TABLE 2

Carbon Source Composition (wt %).

| Carbon | C | B | Al | Ca | Cu | Ni | Si | V | Zn |
|---|---|---|---|---|---|---|---|---|---|
| Graphite | 99.99 | 0.04 | 0.06 | 0.01 | 0.03 | 0.04 | 0.04 | 0.00 | 0.00 |

TABLE 3

Cryolite Source Composition (wt %).

| Cryolite | NaF | $AlF_3$ | $CaF_2$ | $Al_2O_3$ | $MgF_2$ | KF | $P_2O_5$ | $Fe_2O_3$ | Excess $AlF_3$ | $\frac{NaF}{AlF_3}$ (mole) |
|---|---|---|---|---|---|---|---|---|---|---|
| Pure | 60.0 | 40.0 | | | | | | | | 3 |
| Bath Material (BM1) | 43.9 | 39.3 | 5.3 | 2.6 | 0.3 | 0.1 | 0.01 | 0.01 | 10.0 | 2.2 |
| Bath Material (BM2) | 46.7 | 40.8 | 5.2 | 1.3 | 0.2 | 0.2 | 0.01 | | 9.7 | 2.3 |

Baseline Cryolite Tests

In the first test performed, the effect of cryolite was examined in the embodiment of the invention that does not include either pelletization of the mixture or melting of the reduction product. Chromite ore particles with diameters between 75 μm and 106 μm were mixed together with graphite particles having diameters between 53 μm and 74 μm. The chromite ore-carbon-cryolite ratio was 100:23:20. The powdered mixture was heated to 1300° C. in the test furnace and held at 1300° C. for a residence time of two hours.

Figure 2:
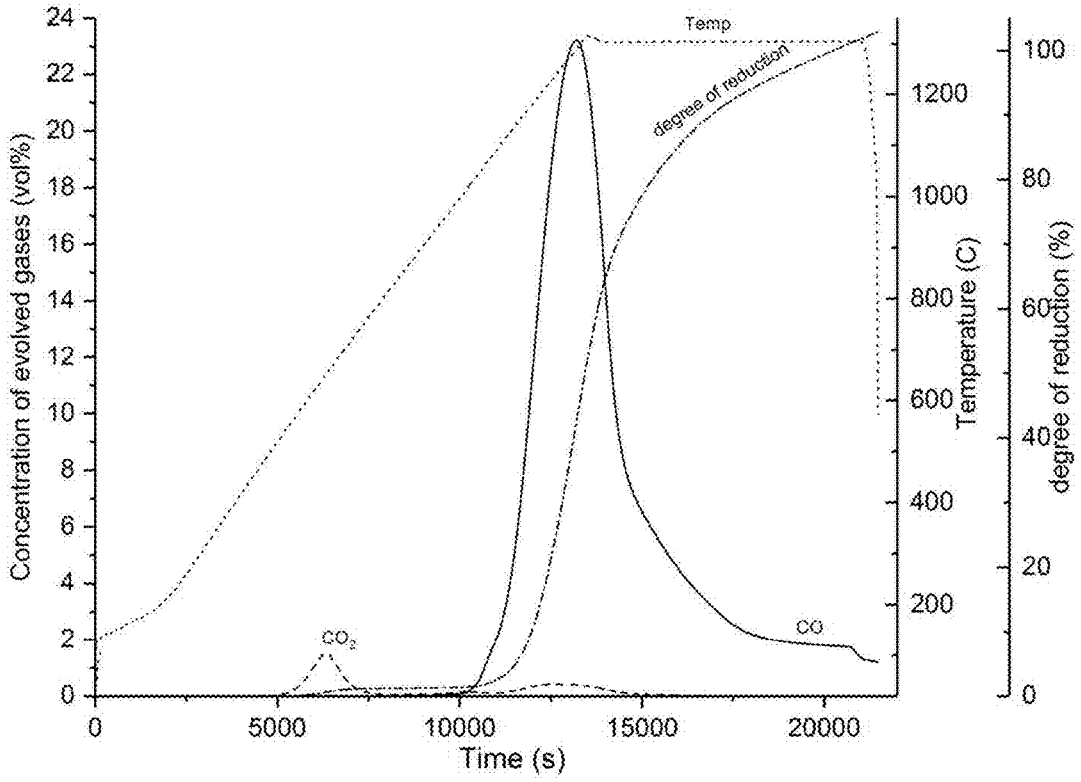
FIG. 2 shows the temperature profile and the concentration of evolved gas during heating of a mixture with a chromite-carbon-cryolite ratio of 100:23:20, heated at 1300° C. for two hours.

FIG. 2 is a chart showing the temperature profile of the mixture and the evolved gas in the furnace in this first test. As can be seen, the powdered mixture was steadily heated and settled at 1300° C. after approximately 13500 seconds. The dominant gas evolution is carbon monoxide (CO), which peaked just before the 1300° C. temperature was reached. The CO level drops drastically during the two-hour residence at 1300° C., but some CO remains (approximately 1.7% by volume), indicating that reduction continues. The line labelled "Reduction %" passes the 100% mark by the end of the two-hour reduction time, clearly showing that the entire sample was reduced.

The chromium and iron metallization rates of the reduced sample were then analyzed, and found to be 97% and 98%, respectively. In the absence of any flux, these metallization rates are typically between 60 and 70%. This leads to the implication that using the cryolite flux significantly increases the metallization rates.

Figure 3:
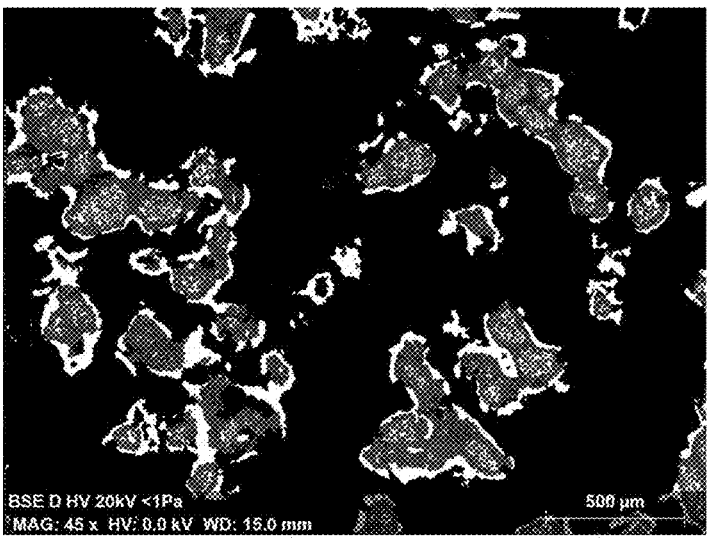
FIG. 3 shows the result after the mixture used for FIG. 2 is reduced and cooled.

FIG. 3 is an SEM micrograph image of this first sample, after reduction. The bright white areas are the ferrochrome alloy, and the light grey phase is the residual chromite and the dark grey phase represents unwanted salt and reduced chromite. As can be seen, the ferrochrome alloy has formed into relatively large nuggets at the interfaces of the reductant and the molten salt phase: analysis of the sample showed a particle size distribution measure ("grind size" or $P_{80}$, a well-known metric in the field) of 68 μm. Later analysis also showed that the alloy phase contained between 56% and 63% chromium and only 23% to 24% iron.

The reduced chromite, moreover, also shows some internal metallization, with a chemical composition of 44% for chromium and 42% for iron. The degree of liberation based on the liberation analysis data is acceptable.

Figure 4A:
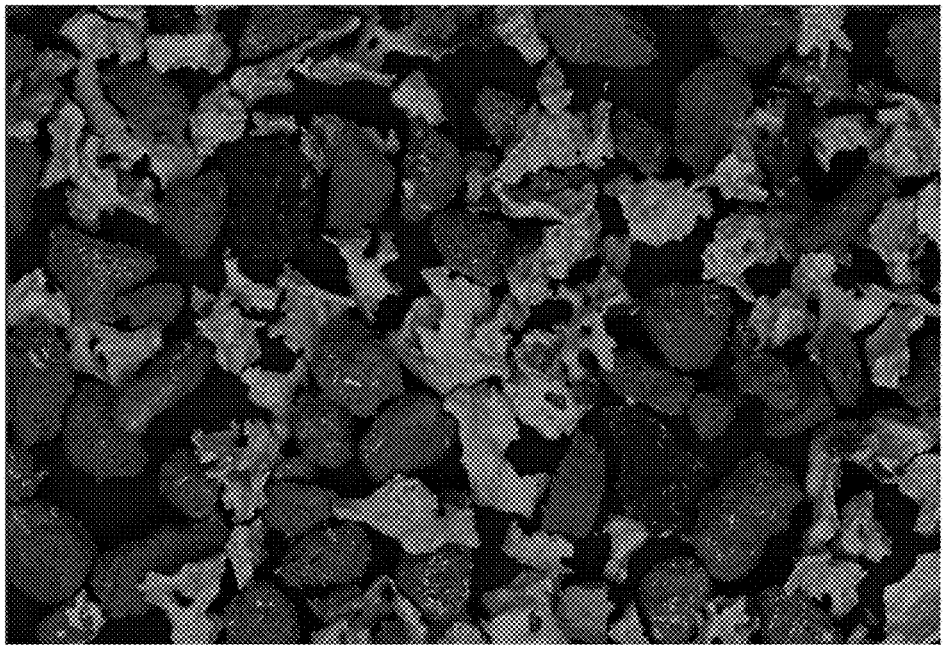
FIG. 4A shows the concentrate resulting from gravity separation of the mixture used in FIG. 2 after reduction.
Figure 4B:
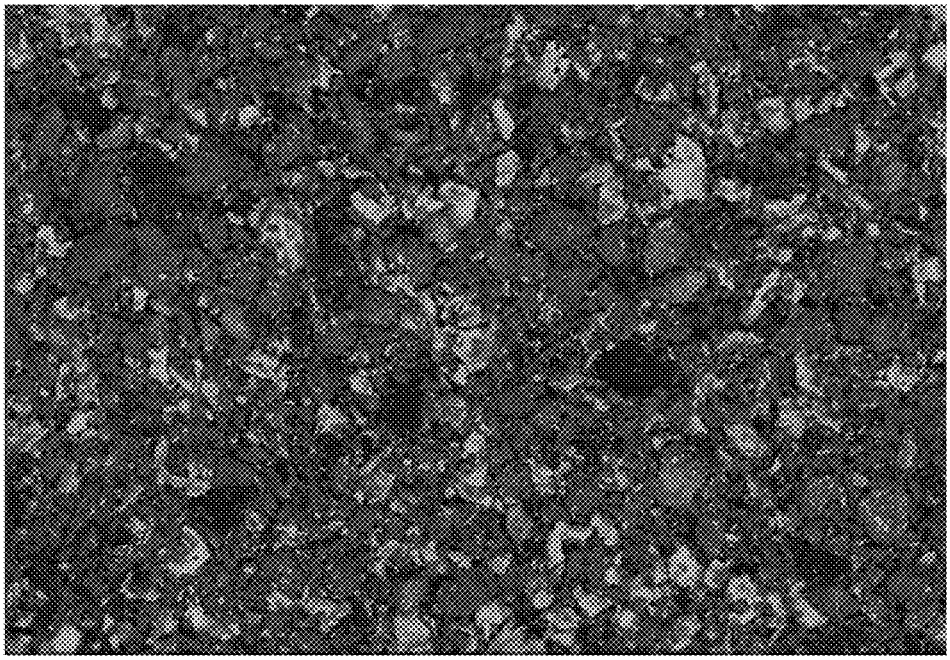
FIG. 4B shows the tailings produced by gravity separation of the mixture used in FIG. 2 after reduction.

Gravity separation techniques were applied to this sample, using a small elutriating tube. FIGS. 4A and 4B show the products of a single-stage separation: FIG. 4A shows the concentrated larger nuggets of the alloy phase and FIG. 4B shows the tailing (smaller pieces of unwanted phases, salt, and gangue). These results can be improved by multi-stage separation or other techniques.

Effects of Pelletization

Figure 5:
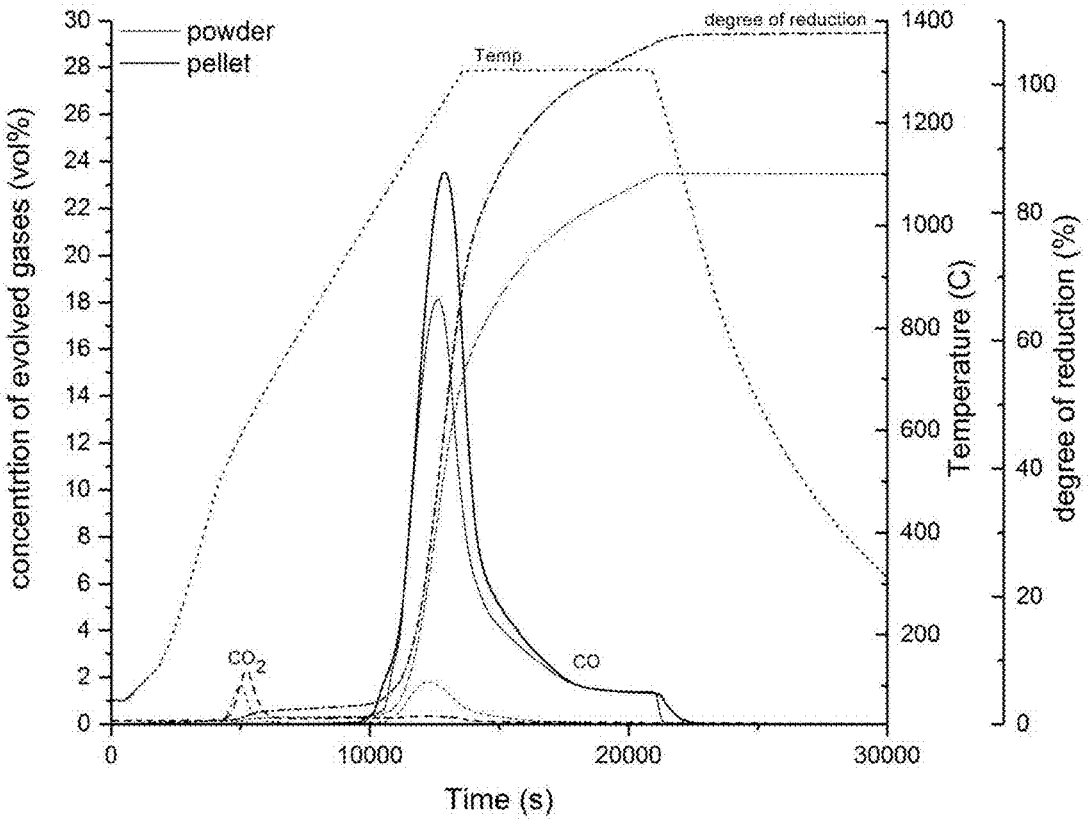
FIG. 5 shows gas evolution and degree of reduction curves of a mixture with a chromite-carbon-cryolite ratio of 100:23:30 in both powdered and pelletized forms.

The effect of pelletization of the mixture was also examined. Pellets were compared with a powdered mixture of the same composition and treated under identical conditions. The mixture used had a chromite-carbon-cryolite ratio of 100:23:30, with chromite particles having diameters between 75 μm and 106 μm, and graphite particles having diameters between 53 μm and 74 μm. Pellets were created by adding this mixture to a manual press with a 13 mm die, and applying four tonnes press force, producing a disc 2 mm in height. Both the powdered mixture and the pellets were heated to 1300° C. for two hours. FIG. 5 shows the evolved gas profile of this test, the furnace temperature, and the percentage reduction.

As can be seen from FIG. 5, the pelletized mixture outperformed the powdered variant, off-gassing more carbon dioxide and carbon monoxide and, based on gas analysis, achieving reduction rates over 100%. Though the powdered mixture did not reach the same level (i.e., not quite reaching 90% reduction), the reduction rates achieved are still significant with improvements over the 60% to 70% reduction seen in reduction without cryolite.

Figure 6A:
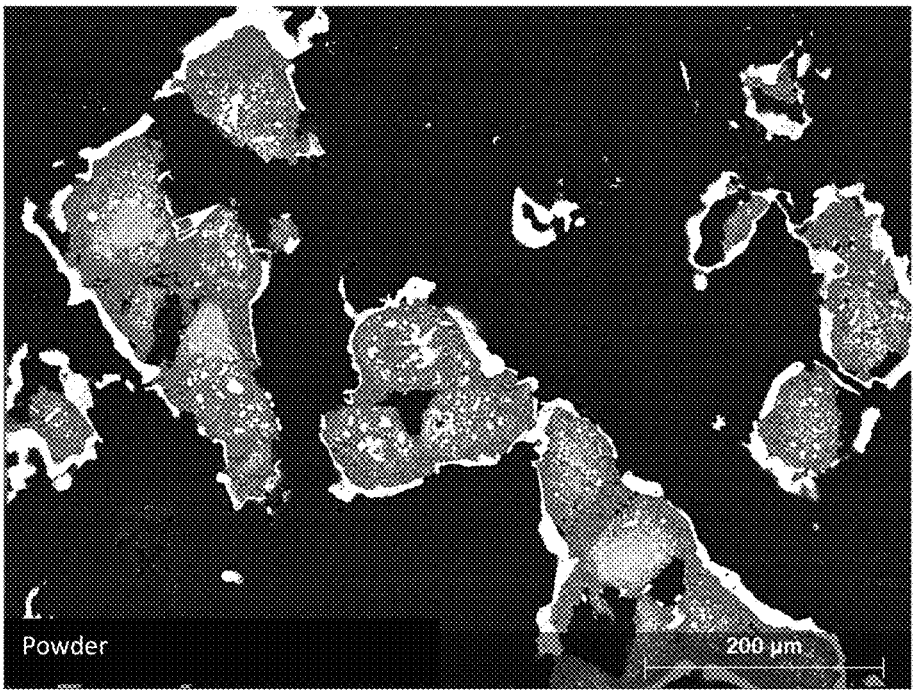
FIG. 6A shows the powdered mixture used in FIG. 5 after reduction and cooling.
Figure 6B:
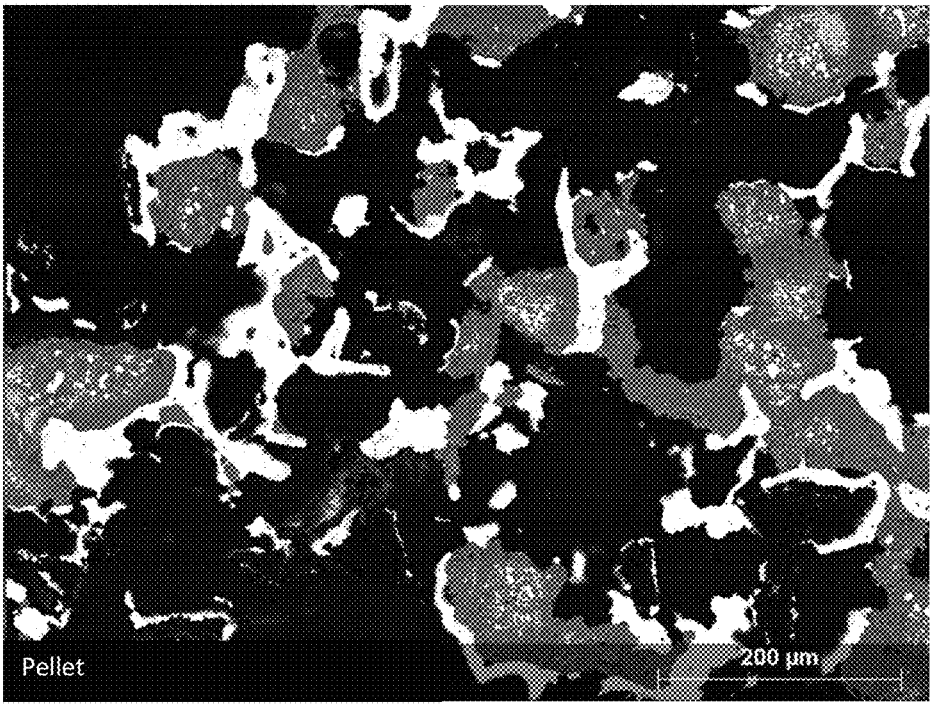
FIG. 6B shows the pelletized mixture used in FIG. 5 after reduction and cooling.

FIGS. 6A and 6B show the results of this test, with FIG. 6A showing the reduced powdered sample and FIG. 6B showing the reduced pelletized sample. It is evident from the images that pelletization substantially improves the metallization rate and increases the size of the metallic alloy nuggets. Analysis of the samples confirms the advantages of pelletization: the metallization rates of the pelletized sample were 97% for chromium and 98% for iron, while in the powder the rates were only 93% for chromium and 97% for iron. The $P_{80}$ size metric for the alloy nuggets in the powdered sample, further, was only 70 μm, while the pelletized sample produced alloy nuggets with a $P_{80}$ metric of 99 μm.

Thus, it should be clear that compressing the powdered mixture into pellets produces better results than leaving it in the powdered form. However, the powdered form still shows high levels of reduction, compared to the prior art, and may be preferred for some applications.

Effects of Pelletizer Press Force

Figure 7:
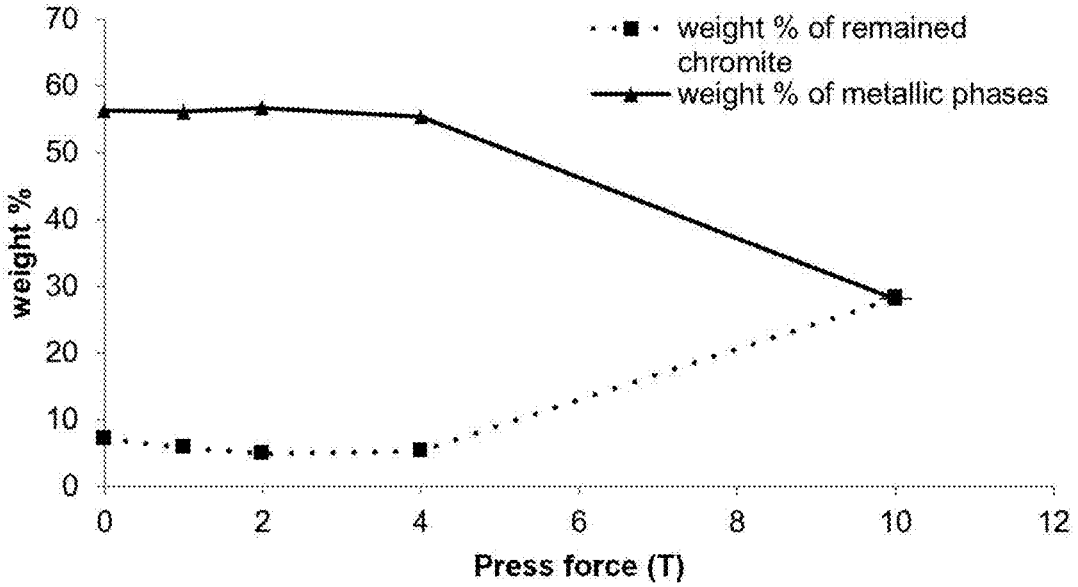
FIG. 7 is a chart showing the effect of pelletizer press force on metallization rates.
Figure 8:
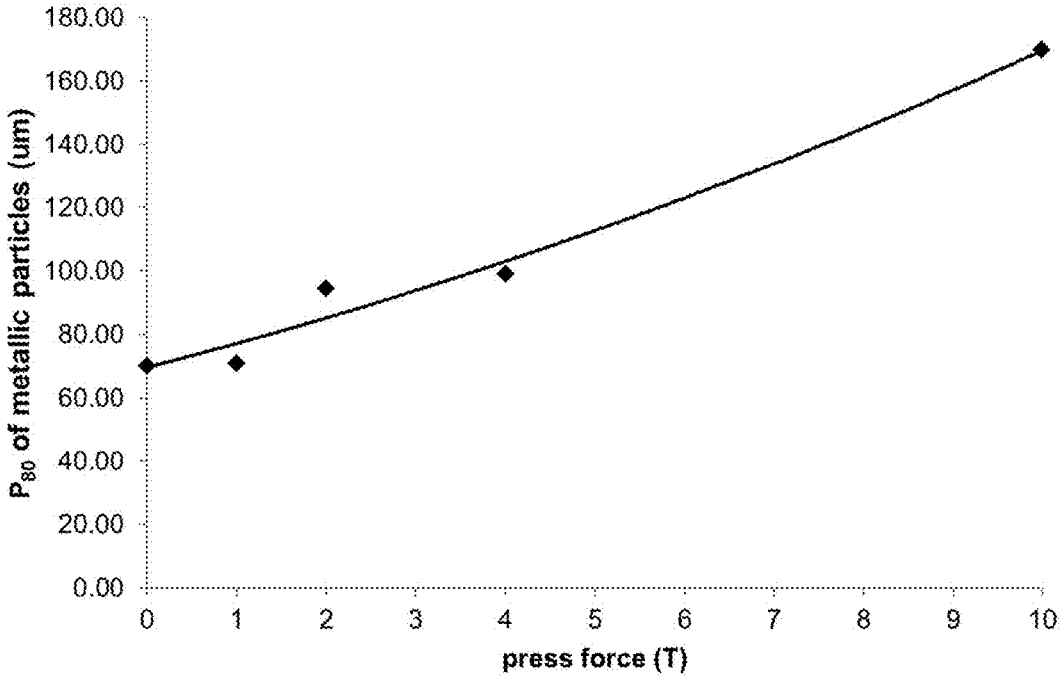
FIG. 8 is a chart showing the effect of pelletizer press force on the size of metallic particles.

The effect of varied press force on the reduction of the pelletized mixture was also examined and the results are shown in FIGS. 7 and 8. FIG. 7 shows the relationship between the press force and the composition by weight of the reduced samples. As can be seen from FIG. 7, as the press force increases above 4 T, the weight percentage of the metallic alloy phase decreases substantially and the weight percentage of the residual chromite phase correspondingly increases.

Likewise, FIG. 8 shows the relationship between the press force and the $P_{80}$ size metric of the alloy nuggets. It can be seen from FIG. 8 that the $P_{80}$ increases relatively smoothly with increasing press force. At a press force of 10 T, the $P_{80}$ of the sample was 170 μm. Thus, it is clear that adjusting the press force alters the end results: depending on the application, higher or lower press forces may be preferable.

Use of Cryolite-Containing Bath Material as Additive

Figure 9:
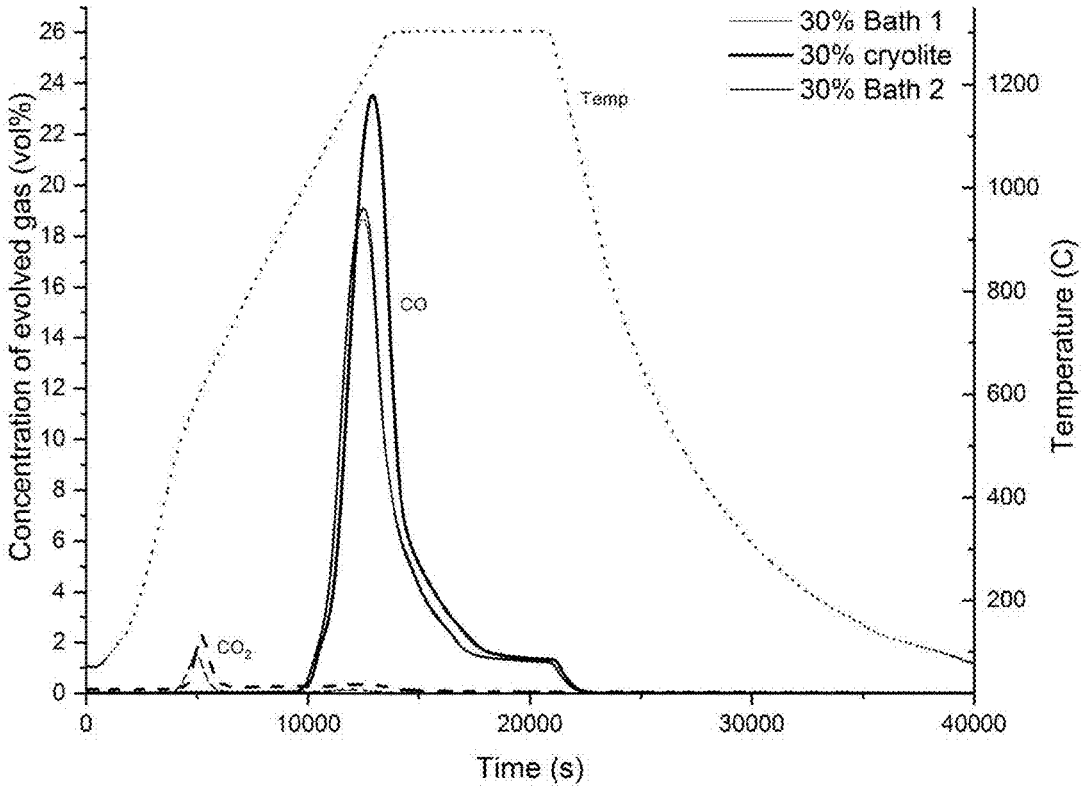
FIG. 9 shows the temperature profile and the concentration of evolved gas during heating of three mixtures with chromite-carbon-additive ratios of 100:23:30.
Figure 10A:
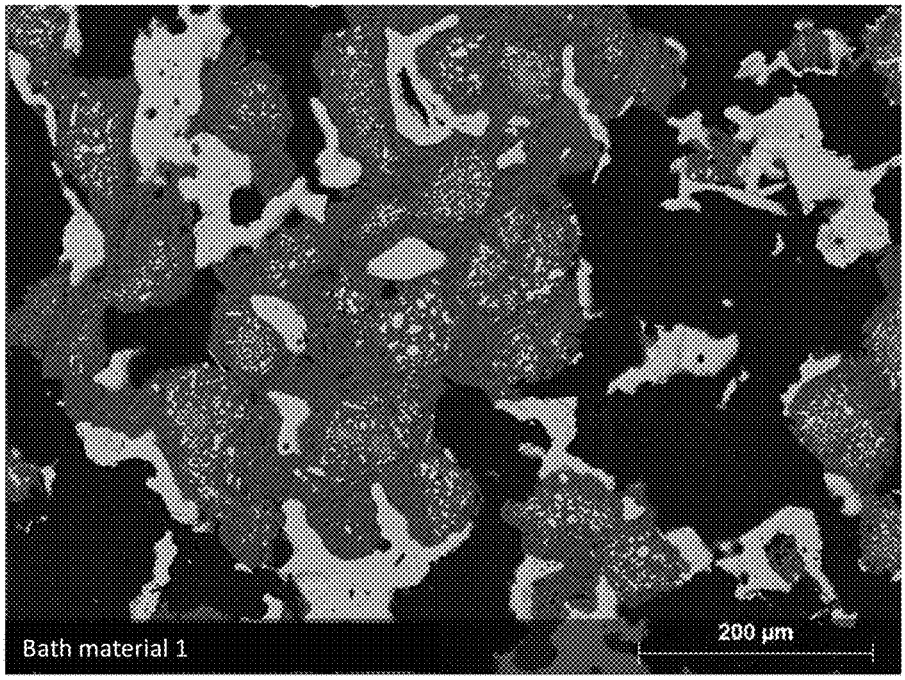
FIG. 10A shows a mixture using bath material (batch BM1) as the cryolite source after reduction and cooling.
Figure 10B:
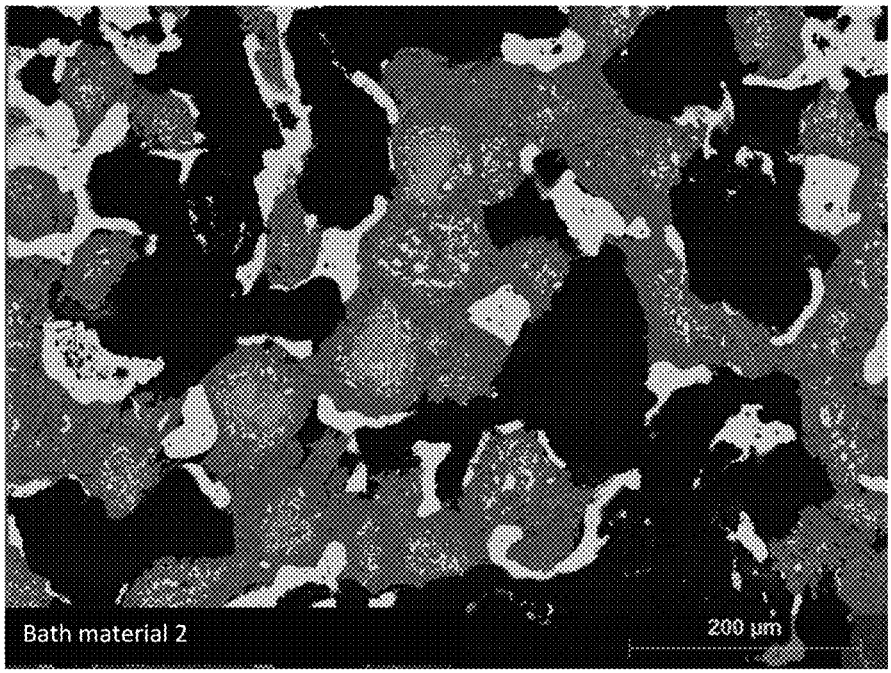
FIG. 10B shows a mixture using bath material (batch BM2) as the cryolite source after reduction and cooling.

Bath material from aluminum smelting was also examined as an additive, and compared with pure cryolite. Two separate batches of bath material were considered, dubbed "BM1" and "BM2". Their composition is shown in Table 3. Each mixture was pelletized with chromite and carbon in a 100:23:30 chromite-carbon-additive ratio, heated to 1300° C., and held in residence at 1300° C. for two hours. FIG. 9 shows the gas evolution and temperature profile for each mixture. As can be seen, the two bath material sources behaved relatively similarly. Although the mixture of 30% pure cryolite produced slightly more carbon monoxide gas, the bath material sources nevertheless produced excellent results. Analysis revealed that 96% of the chromium in batch BM1, and 95% of the chromium in batch BM2, was successfully metallized, and both batches had iron metallization rates of 98%. FIG. 10A shows batch BM1 after reduction. FIG. 10B shows batch BM2 after reduction. From these images it is evident that the bath material produces significant metallization and large metallic alloy nuggets. Indeed, PH size analysis of each sample showed that batch BM1 alloy nuggets had a PH metric of 87 μm and batch BM2 alloy nuggets had a PH metric of 79 μm.

Effects of Residence Time

Next, the effect of residence time on chromite reduction was examined, using four samples of a powdered mixture with a chromite-carbon-cryolite ratio of 100:23:20. (The pure synthetic cryolite was used here.) Each sample was heated to 1300° C., and reduced for (respectively) 10 minutes, 1 hour, 3 hours, and 5 hours.

Figure 11:
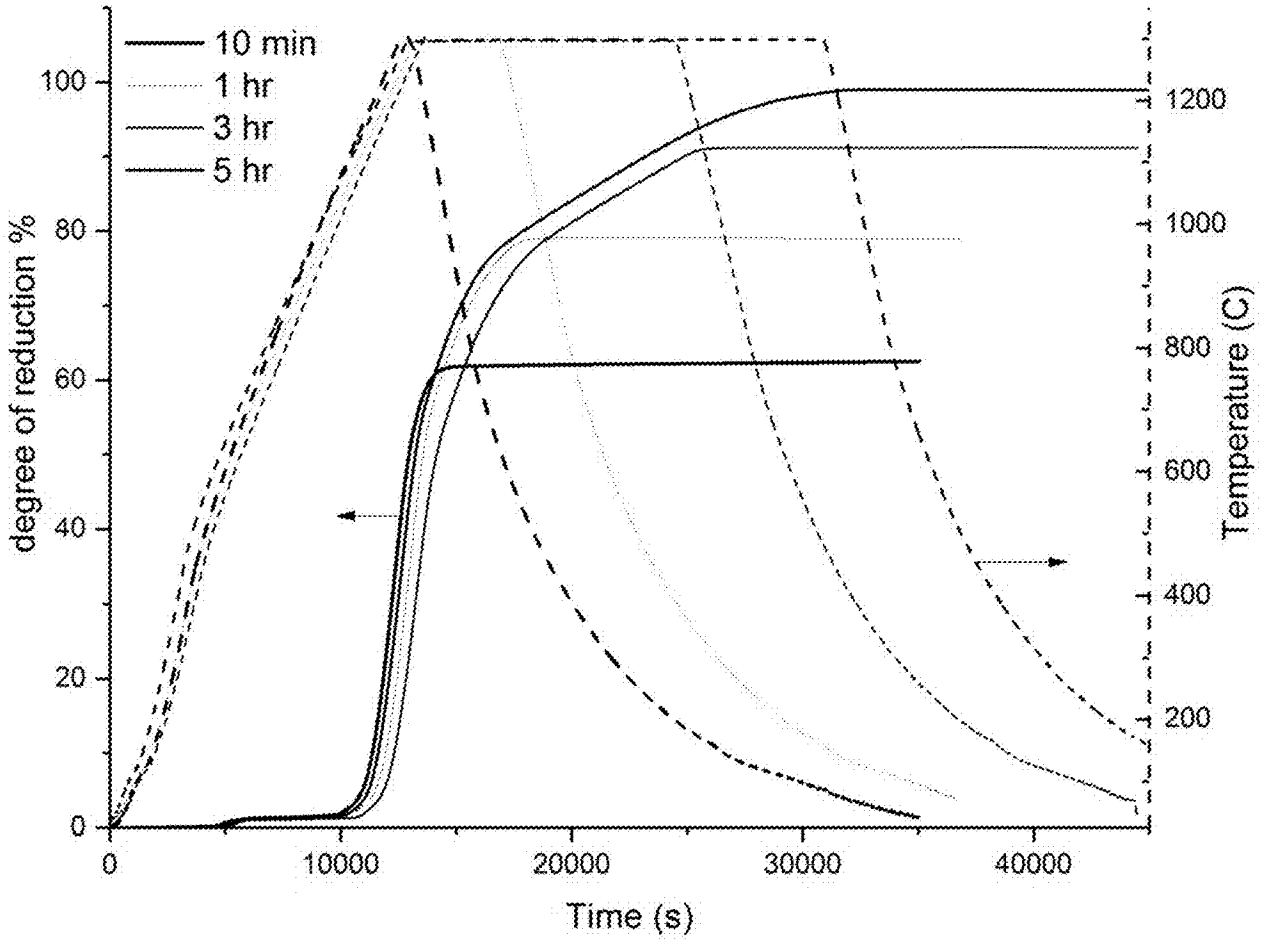
FIG. 11 is a chart showing the effect of different residence times on the reduction of a powder mixture at 1300° C.

FIG. 11 shows the temperature profiles and reduction curves of these samples. As can be seen, the sample reduced for ten minutes only achieved around 60% reduction. The one-hour reduction produced better results, plateauing at just under 80%. However, the three-hour reduction and five-hour reduction were the most effective, achieving just over 90% reduction for the three-hour reduction and just under 100% reduction for the five-hour reduction.

Figure 12:
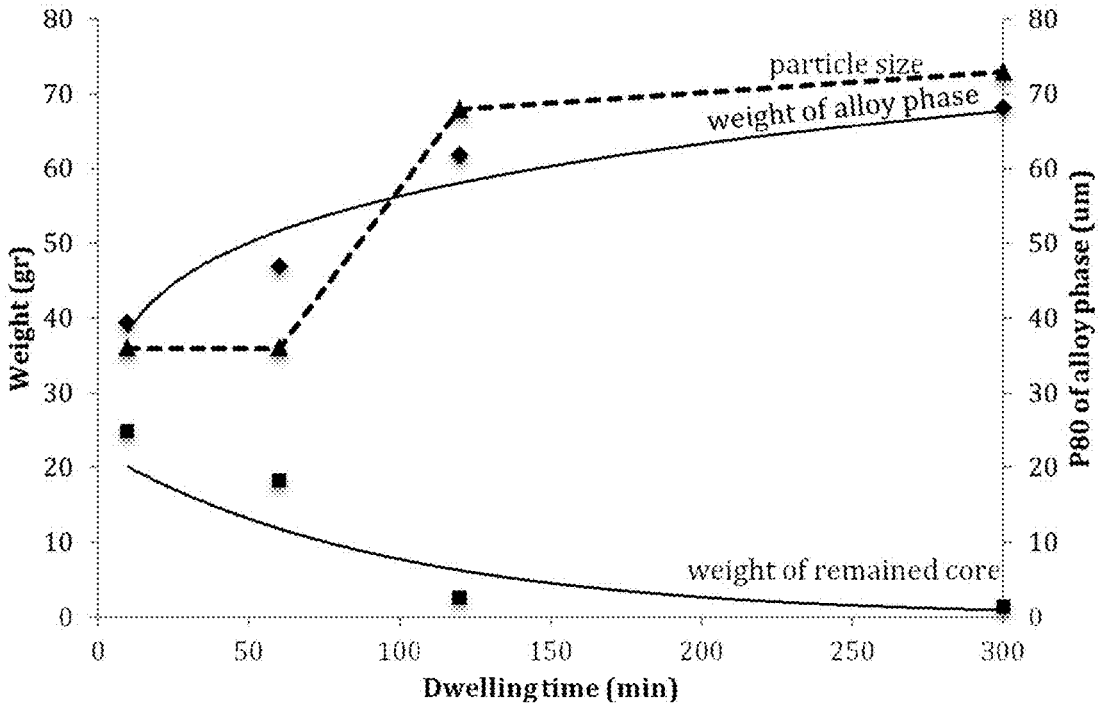
FIG. 12 is a chart showing the effect of different residence times on the metallic phase weight percentage of the mixture used in FIG. 11.

Residence time also affected the weight percentage of the reduced samples and the size distribution of the alloy nuggets. As shown in FIG. 12, both the percentage weight of the alloy phase and the particle size substantially increased between the one-hour residence time and the two-hour residence time, suggesting that longer residence times would be preferable. However, the difference between the two-hour reduction and the five-hour reduction was not as pronounced. Thus, when accounting for the greater energy costs of longer residence times, a two-hour reduction may well be preferred over longer times.

Figure 13A:
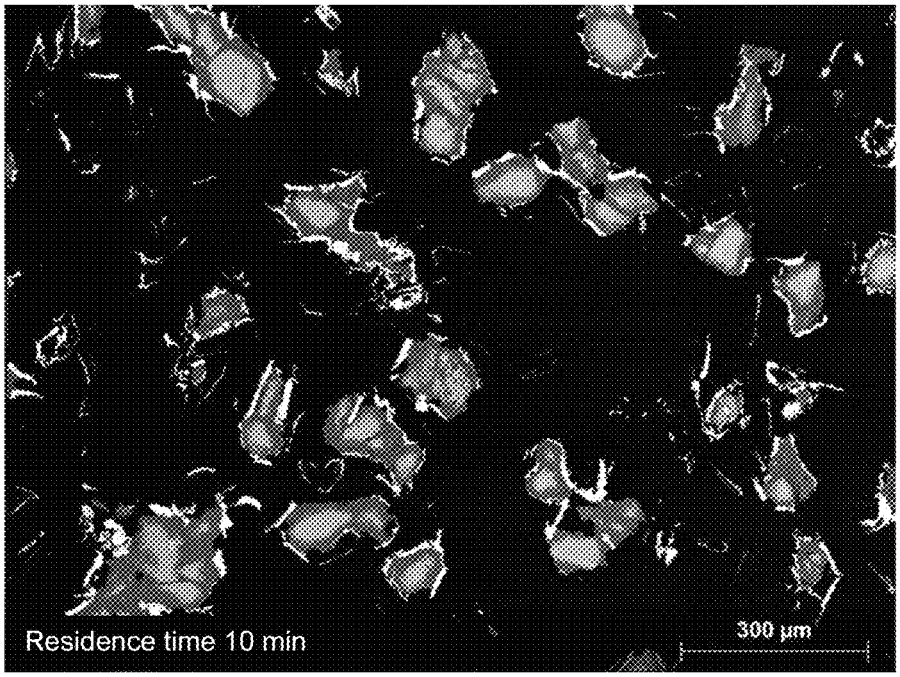
FIG. 13A shows the mixture used in FIG. 11 after a 10-minute residence time at 1300° C.
Figure 13B:
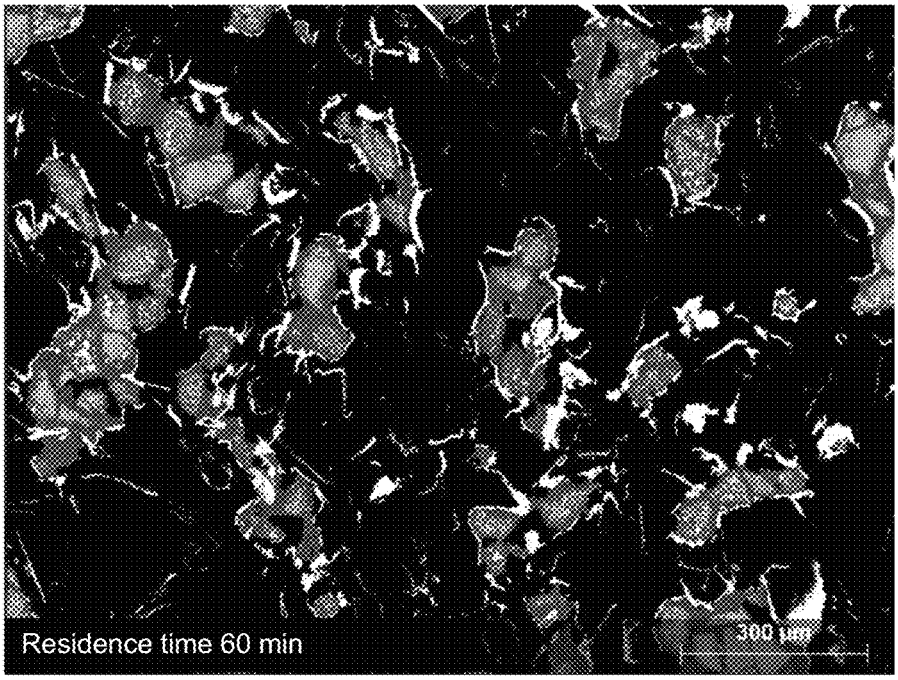
FIG. 13B shows the mixture used in FIG. 11 after a 60-minute residence time at 1300° C.
Figure 13C:
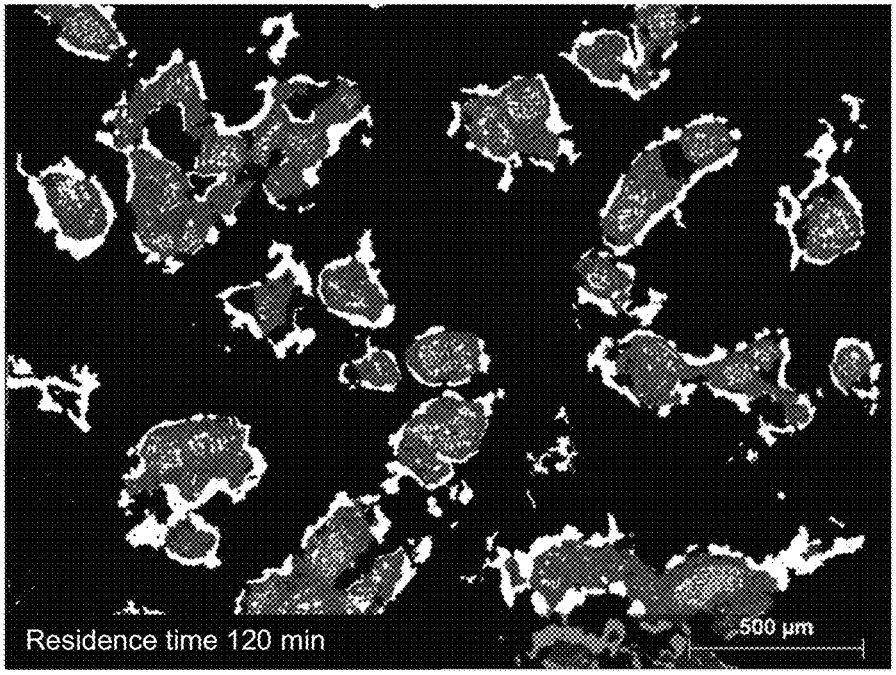
FIG. 13C shows the mixture used in FIG. 11 after a 120-minute residence time at 1300° C.
Figure 13D:
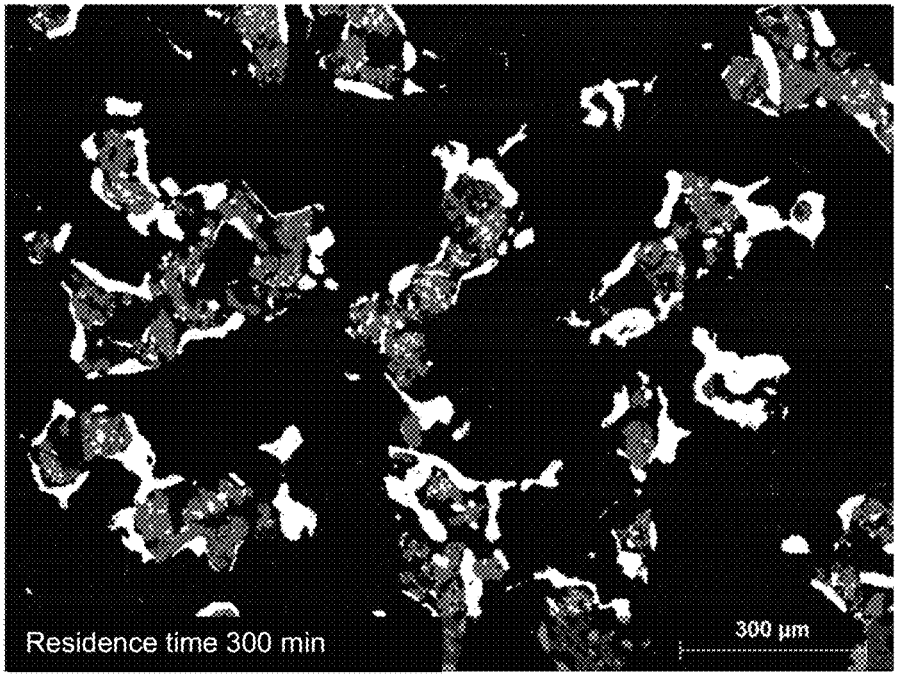
FIG. 13D shows the mixture used in FIG. 11 after a 300-minute residence time at 1300° C.

The reduced samples from these tests are shown in FIGS. 13A-13D. FIG. 13A, an image of the sample reduced for only 10 minutes, shows some reduction (bright white area), but much less than other tests. The metallization percentage increases with time, as can be seen: there is more of the bright white area in FIG. 13B than in FIG. 13A, and even more in FIG. 13C than in FIG. 13B. However, FIG. 13D, though having slightly more metallization than FIG. 13C, does not show dramatically greater metallization.

Table 4 shows the chemical composition by weight of the metallic alloy nuggets formed in each of these four samples shown in FIGS. 13A-13D. The weight percentage of chromium and iron is given, as is the weight percentage of silicon. As can be seen, each of the samples has a high ratio of chromium to iron (between approximately 2.2 and approximately 2.4).

TABLE 4

Alloy Nugget Composition by Weight for Varied Residence Times.

| Residence Time | Chromium Weight Percentage | Iron Weight Percentage | Silicon Weight Percentage |
|---|---|---|---|
| 10 minutes | 56 | 22 | 0 |
| 60 minutes | 60 | 27 | <1 |
| 120 minutes | 57 | 24 | <1 |
| 300 minutes | 60 | 25 | 0.5 |

Figure 14:
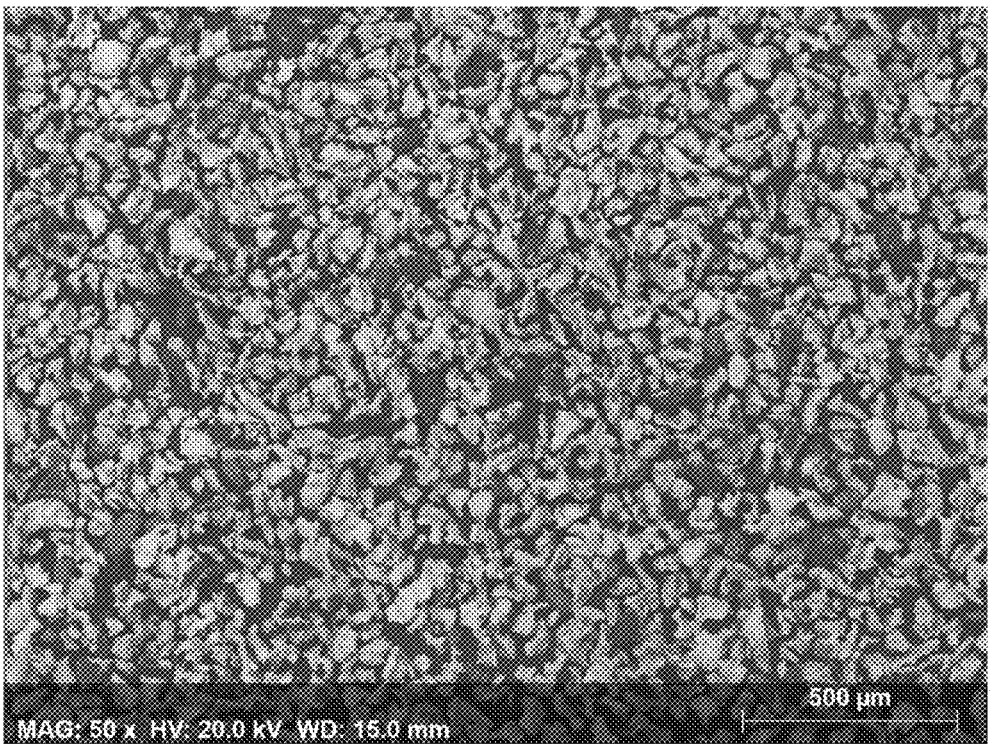
FIG. 14 shows the metallic particles concentrated by magnetic separation of the product forms shown in FIG. 13D.
Figure 15:
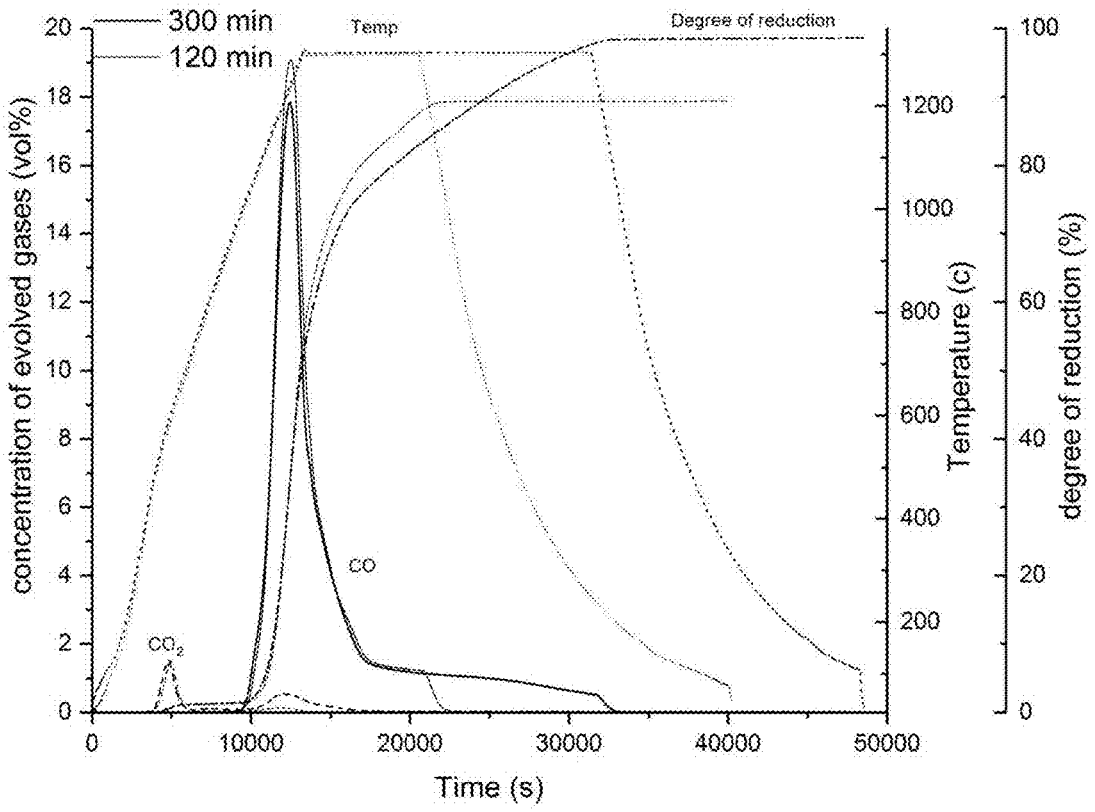
FIG. 15 shows the temperature profile and the concentration of evolved gas during heating of a pelletised mixture with a chromite-carbon-cryolite (BM2) ratio of 100:23:30.

The result of magnetic separation of the metallic phase formed after 5 hr. reduction from the gangue materials after magnetic separation is shown in FIG. 14. This image illustrates a perfect separation after two cycles of magnetic separation. Residence time evaluations were also performed for mixtures using a bath material source as the additive (specifically, batch BM2). FIG. 15 shows the evolved gas profiles, the furnace temperature, and the reduction curves for a pelletized mixture with a chromite-carbon-cryolite ratio of 100:23:30, where the cryolite is batch BM2 bath material, reduced for 2 hours and for 5 hours.

Again, the difference between two-hour reduction and five-hour reduction, though evident, is not so pronounced as to render a two-hour residence time useless. After two hours, 89% of the sample was reduced. After five hours, the reduction had reached 100%. Additionally, analysis showed that the weight percentage of the residual chromite phase was 6.7% after two hours, and more than halved (2.4%) after five hours. Further, increasing the residence time from two hours to five hours increased the $P_{80}$ metric from 79 μm to 111 μm. However, again, the greater energy input needed for five-hour reduction may offset its advantages over a two-hour reduction.

Effects of Cryolite Concentration in Mixture

Figure 16:
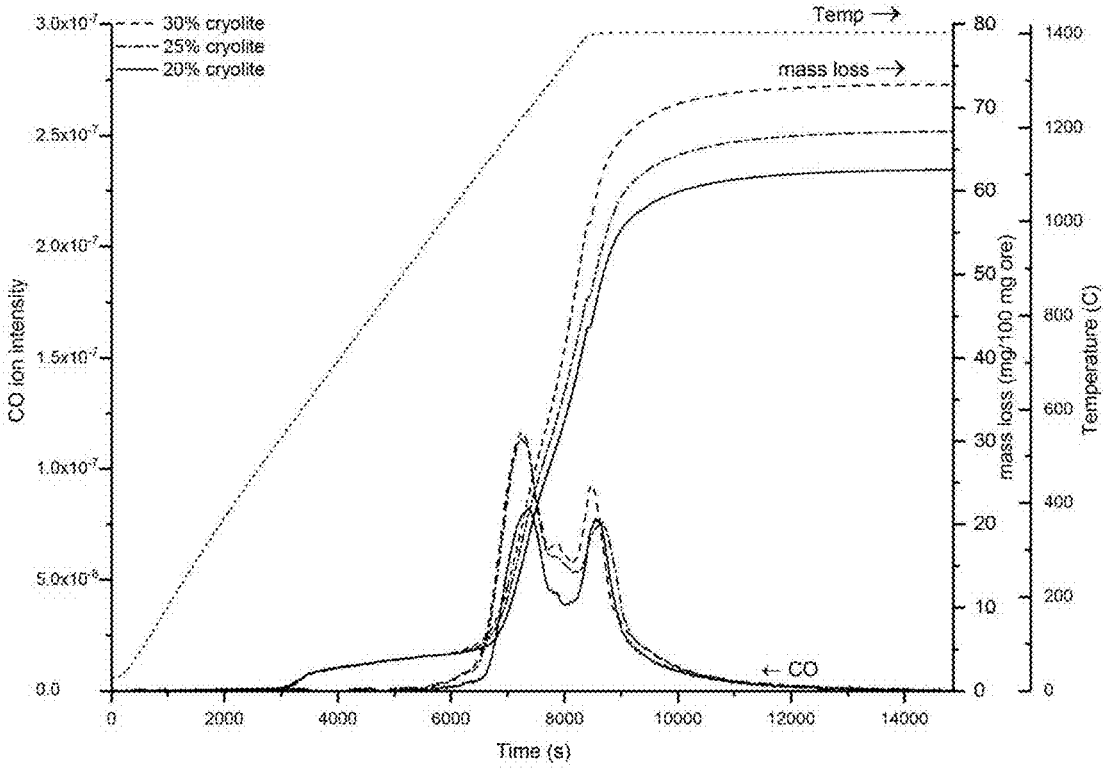
FIG. 16 shows the temperature profile, mass loss, and concentration of evolved gas for powdered mixtures with chromite-carbon-cryolite ratios of 100:25:20, 100:25:25, and 100:25:30.

The effect of varying the cryolite concentration was examined by testing three different powdered mixtures. The first mixture had a chromite-carbon-cryolite ratio of 100:25:20. The second mixture had a chromite-carbon-cryolite ratio of 100:25:25. The third mixture had a chromite-carbon-cryolite ratio of 100:25:30. FIG. 16 shows the temperature profile and evolved carbon monoxide from each sample, as well as the mass loss from thermogravimetric analysis. The mass loss, though correlated with the degree of reduction, is subject to other factors, and thus an analysis of the evolved gas is generally a better predictor of reduction success. As can be seen, though the mixture with only 20% cryolite is out-performed by both the 25% cryolite and 30% cryolite mixtures, there is no significant difference between the reduction levels in the 25% mixture and the 30% mixture.

Figure 17A:
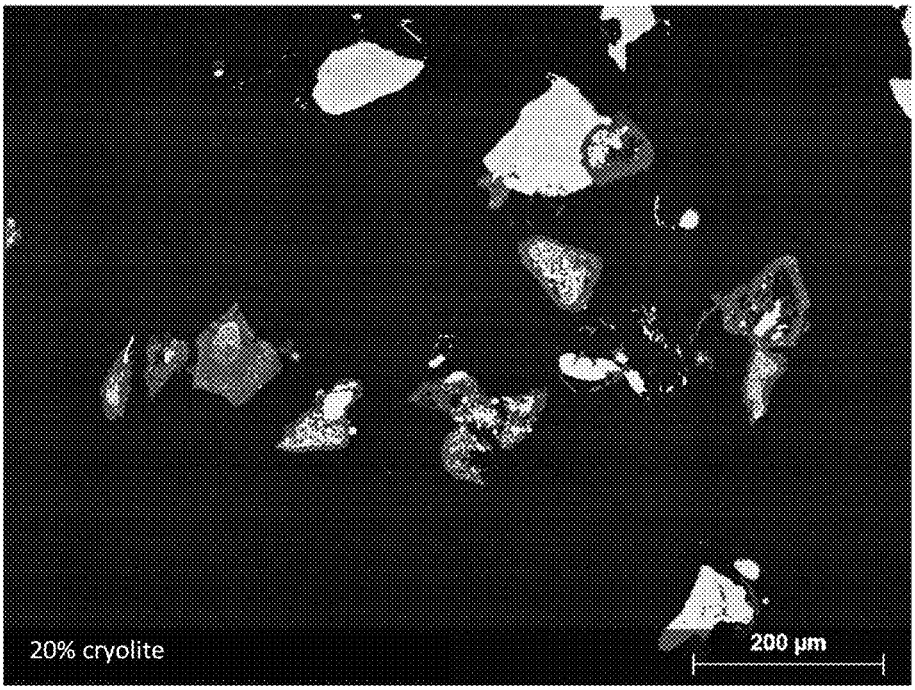
FIG. 17A shows a powdered mixture with a chromite-carbon-cryolite ratio of 100:25:20 after reduction.
Figure 17B:
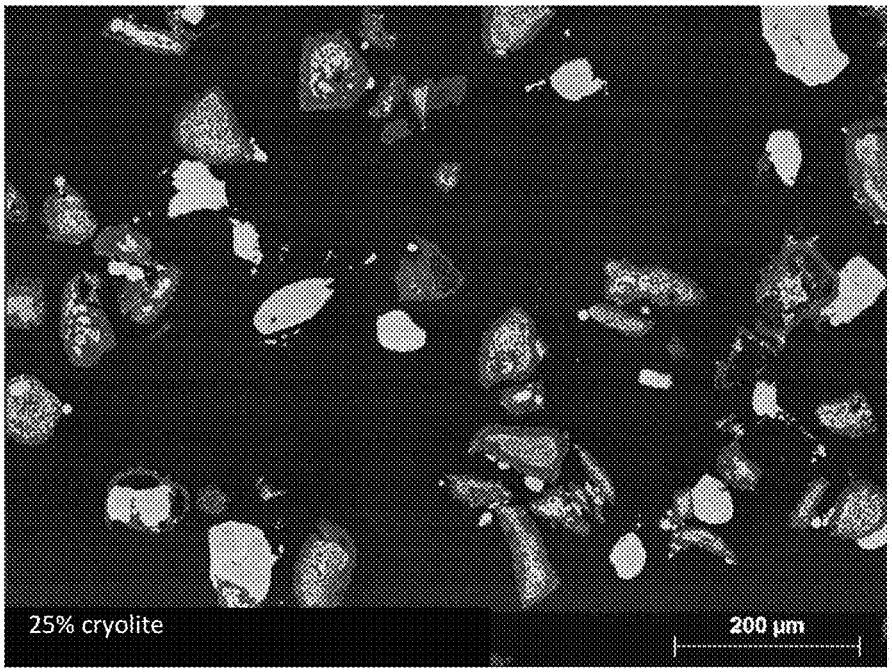
FIG. 17B shows a powdered mixture with a chromite-carbon-cryolite ratio of 100:25:25 after reduction.
Figure 17C:
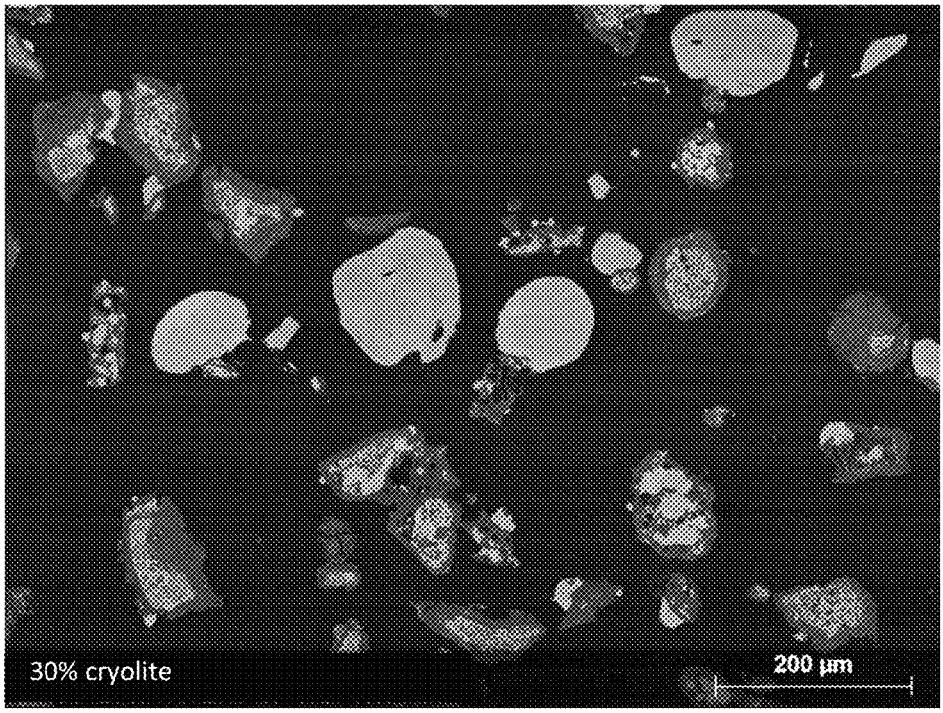
FIG. 17C shows a powdered mixture with a chromite-carbon-cryolite ratio of 100:25:30 after reduction.

From FIGS. 17A-17C, it can be seen that complete reduction was achieved with each of the three mixtures. FIG. 17A, illustrating the reduced 20% cryolite mixture, shows relatively large metallic alloy nuggets and no unreacted phase. The same can be said for FIGS. 17B and 17C (with FIG. 17B showing 25% cryolite and FIG. 17C showing 30% cryolite). Differences between each figure are not readily apparent to the naked eye. Thus, while mixtures with cryolite concentrations between 25% and 30% by weight may be optimal, mixtures with cryolite concentrations as low as 20% may also be useful for some applications.

Effect of Graphite Particle Size

Graphite particle size was varied to examine its effects on chromite reduction. Five different mixtures were tested, each using chromite particles of diameters between 75 μm and 106 μm and having a chromite-carbon-cryolite ratio of 100:25:30. Pure synthetic cryolite was also used (as opposed to bath material).

Figure 18:
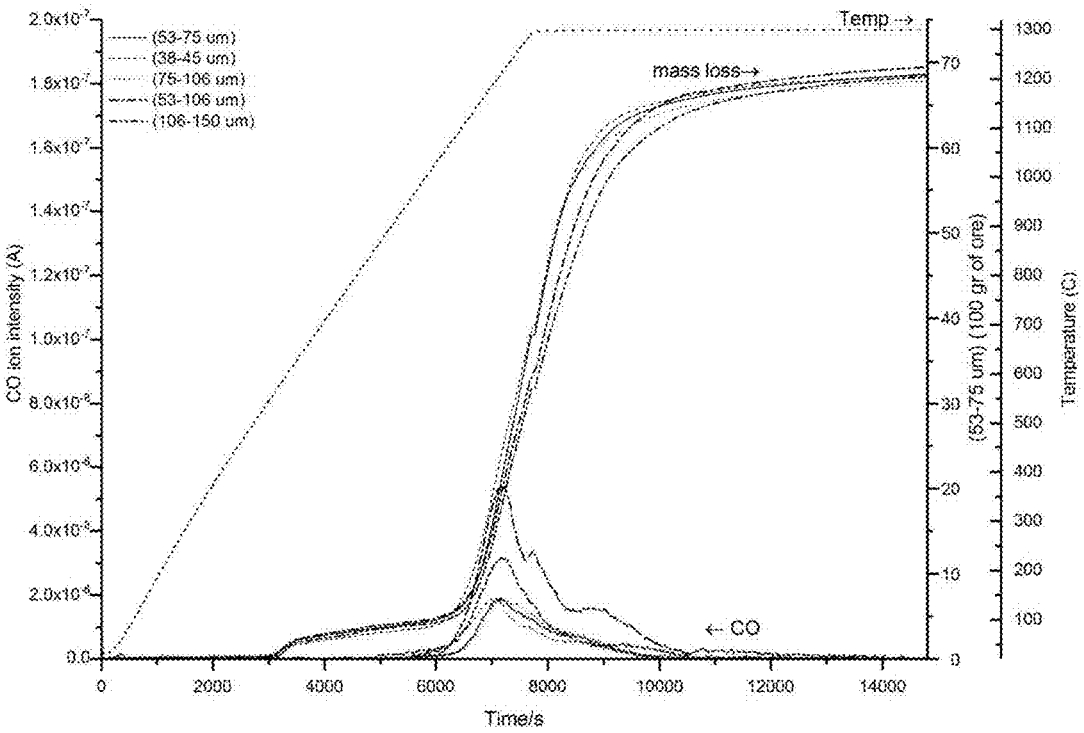
FIG. 18 shows the mass loss and concentration of evolved gas for powdered mixtures with a chromite-carbon-cryolite ratio of 100:25:30 with different graphite particle sizes.

FIG. 18 shows the mass loss, temperature profile, and evolved carbon monoxide for each set of graphite particles from thermogravimetric measurement. Table 5 shows the same data in numerical form. As can be seen, the mass loss curves are very similar. There is slightly more variance in the carbon monoxide lines: the graphite particles with diameters between 106 μm and 150 μm out-perform most of the smaller sets, but the set of particles with diameters between 53 μm and 106 μm was most effective and produced the highest carbon monoxide peak. Thus, experimental results suggest that the optimal graphite particle diameter is between 53 μm and 106 μm.

TABLE 5

Mass Loss and CO Gas Evolution with Varied Graphite Particle Size.

| Graphite Particle Size | % Mass Loss/1 mg Chromite | (Mass Loss) - (Mass Loss from $H_2O$ Evaporation) - (Mass of Cryolite) | Total Carbon Monoxide (CO) Gas Intensity |
|---|---|---|---|
| 53 μm-75 μm | 68.77 | 35.87 | 4.220E−05 |
| 38 μm-45 μm | 68.79 | 36.29 | 3.990E−05 |
| 75 μm-106 μm | 68.07 | 35.37 | 3.950E−05 |
| 106 μm-150 μm | 68.3836 | 35.38 | 6.630E−05 |
| 53 μm-106 μm | 70.1852 | 37.19 | 9.050E−05 |

Effect of Chromite Ore Particle Size

In these tests, the size of the chromite ore particles was varied, to examine the effect of chromite ore particle size on chromite reduction. Additionally, two sets of graphite particles were used (one set having diameters between 53 μm and 75 μm, the other having diameters between 105 μm and 150 μm) to examine any potential interaction between particles of different sizes. The composition of each tested mixture is shown in Table 6.

TABLE 6

Mixture Composition with Varied Particle Size.

| Mixture | Graphite Particle Size (μm) | Chromite Particle Size (μm) | Chromite-Carbon-Cryolite Ratio |
|---|---|---|---|
| A.1 | 53-75 | 53-74 | 100:25:30 |
| A.2 | 53-75 | 75-90 | 100:25:30 |
| A.3 | 53-75 | 75-106 | 100:25:30 |
| B.4 | 105-150 | 37-44 | 100:25:30 |
| B.5 | 105-150 | 75-105 | 100:25:30 |

Figure 19:
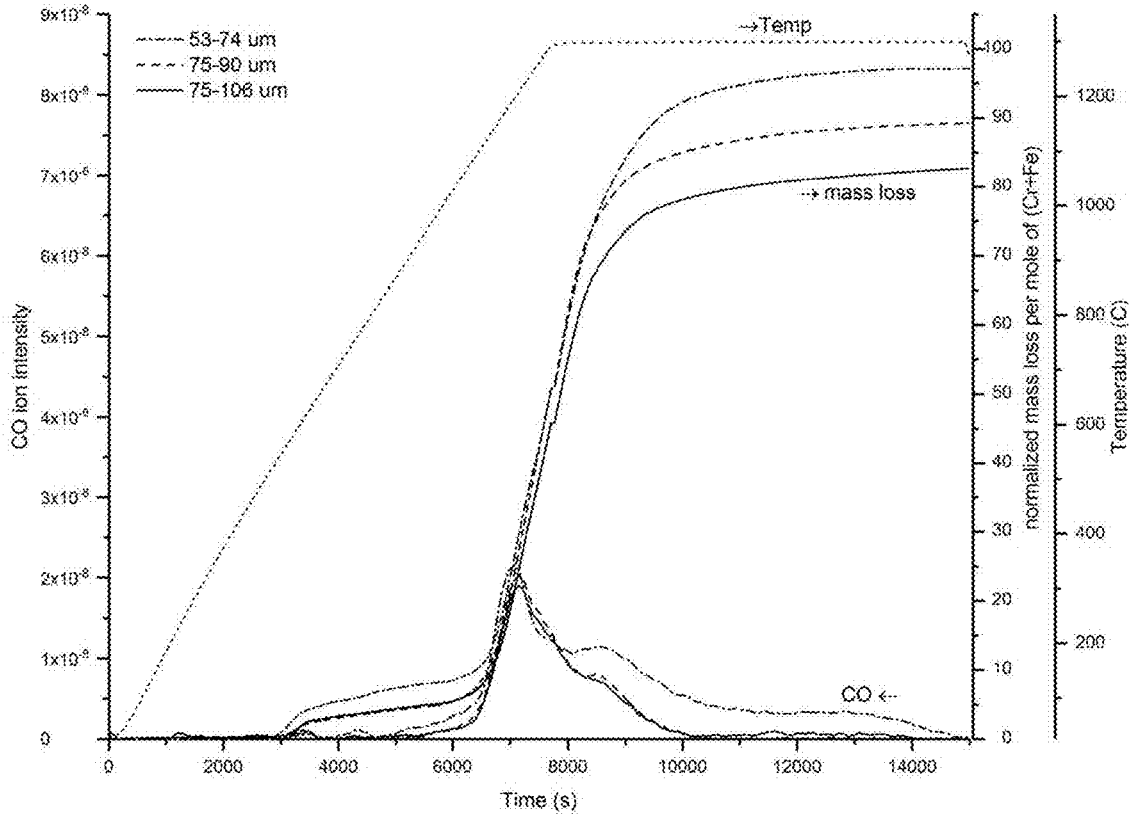
FIG. 19 shows the mass loss and concentration of evolved gas for powdered mixtures with a chromite-carbon-cryolite ratio of 100:25:30 with different ore particle sizes.

FIG. 19 shows the temperature profile, the mass loss curves, and the carbon monoxide profiles for mixtures A.1, A.2, and A.3 (as defined in Table 6) from thermogravimetric measurements. As the concentrations of chromite and iron oxide (which are relevant to mass loss) necessarily change with chromite particle size, the mass loss data shown in FIG. 19 was normalized per mole of (Cr+Fe)—that is, per mole of combined chromium and iron. Table 7, additionally, shows normalized mass loss and carbon monoxide data.

TABLE 7

Mass Loss and CO Gas Evolution with Varied Chromite Particle Size.

| Mixture | % Mass Loss/ mole (Cr + Fe) | (Mass Loss)-(Mass Loss from $H_2O$ Evaporation)-(Mass of Cryolite) | Total Carbon Monoxide (CO) Gas Intensity |
|---|---|---|---|
| A.1 | 97.8 | 62.3 | 5.840E−05 |
| A.2 | 89.51 | 56.2 | 3.110E−05 |
| A.3 | 82.81 | 49.2 | 3.010E−05 |

Figure 20A:
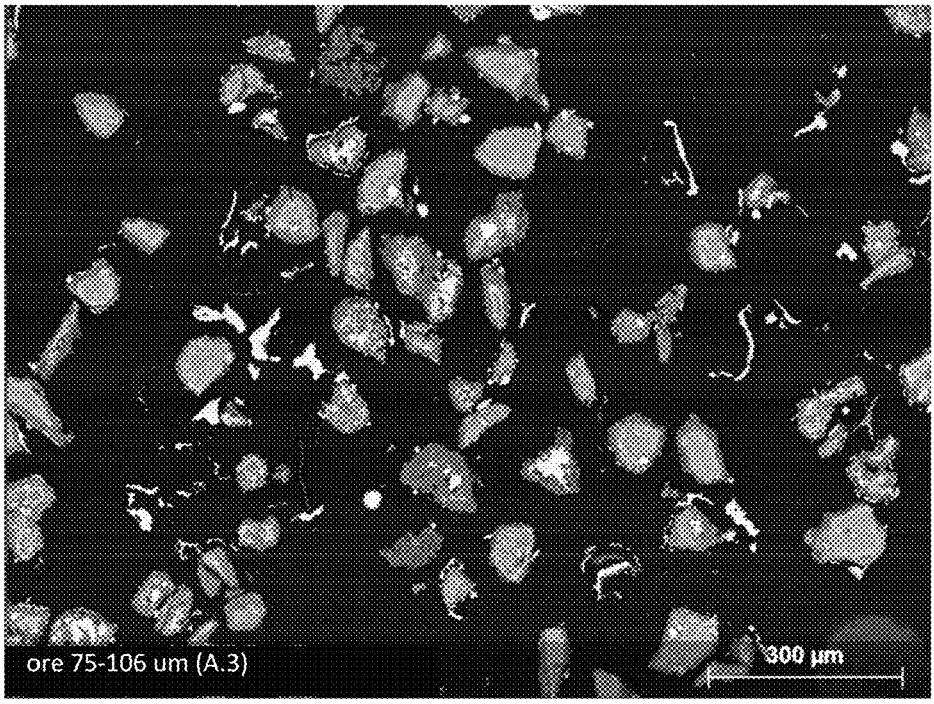
FIG. 20A shows a powdered mixture with a chromite-carbon-cryolite ratio of 100:25:30 and chromite particle diameter between 75 μm and 106 μm, after reduction.
Figure 20B:
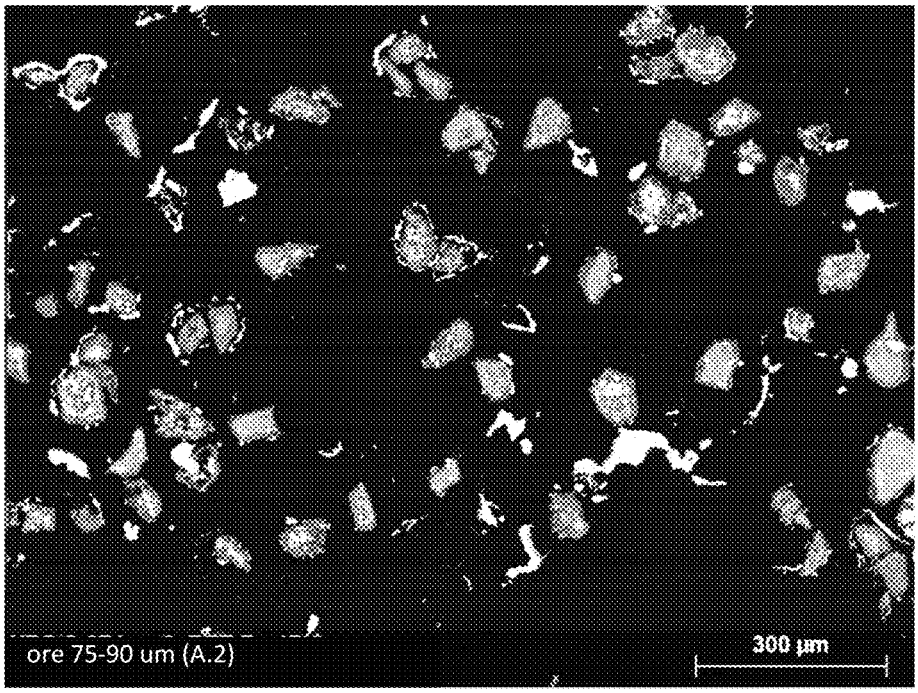
FIG. 20B shows a powdered mixture with a chromite-carbon-cryolite ratio of 100:25:30 and chromite particle diameter between 75 μm and 90 μm.
Figure 20C:
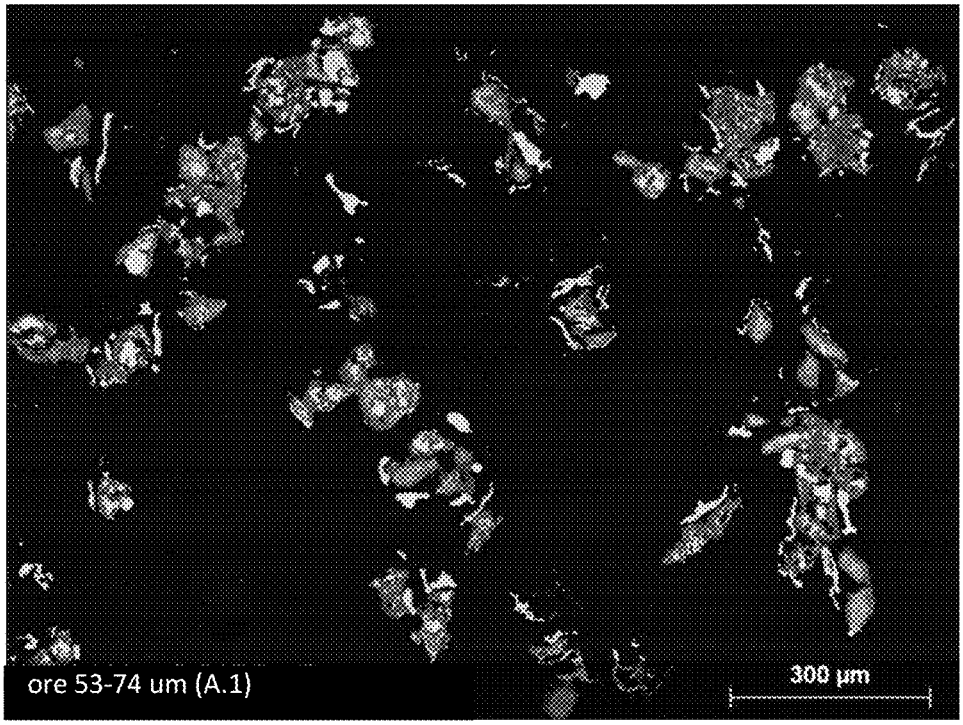
FIG. 20C shows a powdered mixture with a chromite-carbon-cryolite ratio of 100:25:30 and chromite particle diameter between 53 μm and 74 μm.

As can be seen from the CO curves and the intensity data, mixture A.1 (with the smallest chromite particle sizes) was more effective for reduction than mixtures with larger chromite particles. This is also evident from FIGS. 20A-20C, which show mixtures A.3, A.2, and A.1, respectively. It is clear from these images that greater levels of reduction are achieved with mixture A.1 (FIG. 20C): there is substantially less of the unreduced core phase in each image as the particle size is decreased.

Figure 21:
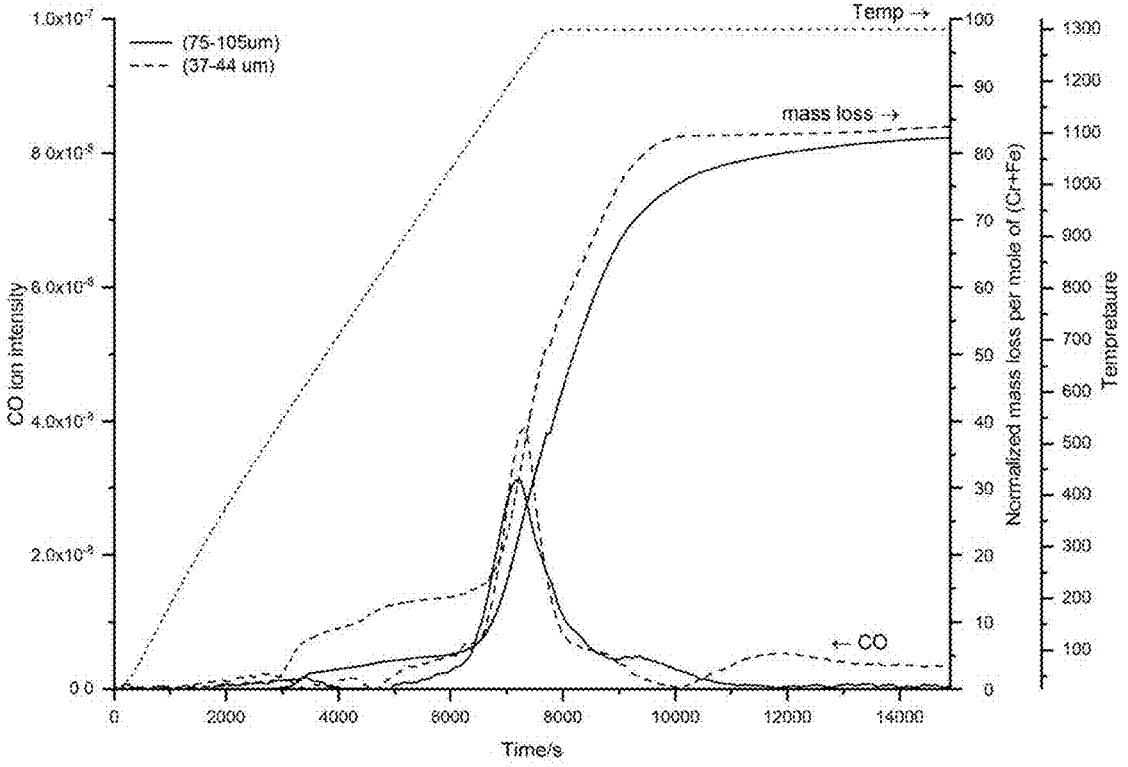
FIG. 21 shows the mass loss and concentration of evolved gas for powdered mixtures with a chromite-carbon-cryolite ratio of 100:25:30 with different ore particle sizes.
Figure 22A:
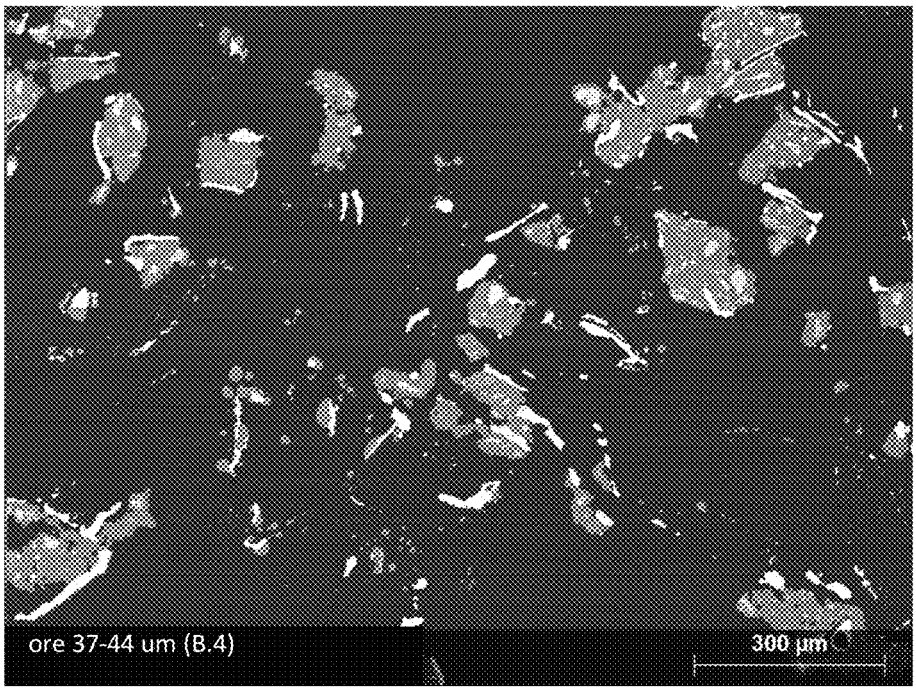
FIG. 22A shows the mixture used in FIG. 21 with chromite particle diameter between 37 μm and 44 μm after reduction.
Figure 22B:
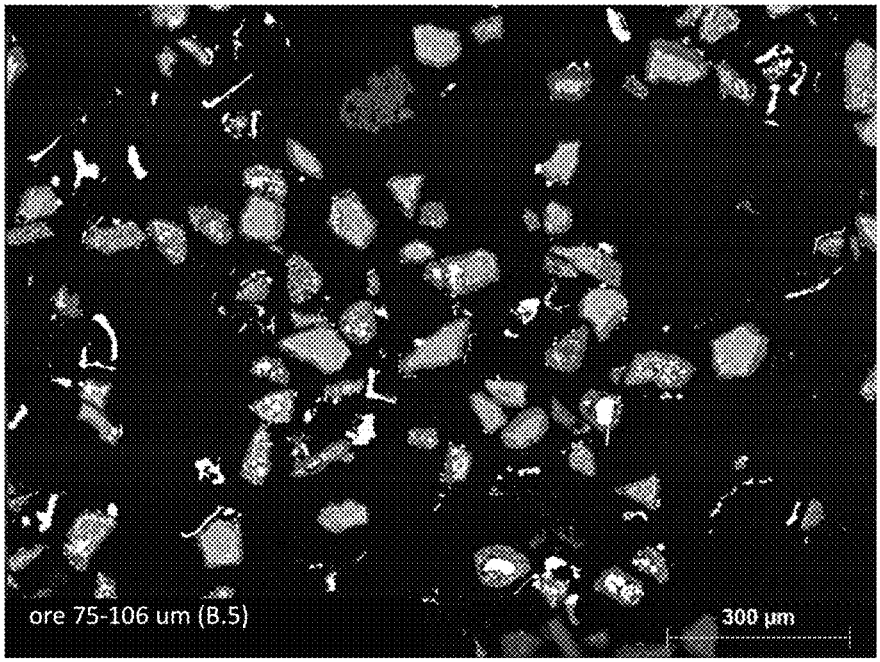
FIG. 22B shows the mixture used in FIG. 21 with chromite particle diameter between 75 μm and 106 μm after reduction.

Finally, varied chromite particle size was examined in mixtures B.4 and B.5 (which use larger graphite particles than the "A" mixtures of Table 6). Again, as can be seen from FIG. 21, which shows the temperature profile, evolved gas, and mass loss during reduction of mixtures B.4 and B.5, the mixture with smaller chromite particles (B.4) achieved higher reduction levels than the mixture with larger chromite particles. FIGS. 22A and 22B, showing the reduced mixtures B.4 and B.5, respectively, confirm this analysis. Thus, it is apparent that smaller chromite particles improve the effectiveness of the reduction process no matter the size of the reductant particles.

A better understanding of the present invention may be obtained by consulting the following references:

[1] F. Winter, "Production of Chromium Iron Alloys Directly from Chromite Ore," US Patent Publication US2016/0244864 A1, 2016.

[2] H. G. Katayama, M. Tokuda, and M. Ohtani, "Promotion of the Carbothermic Reduction of Chromium Ore by the Addition of Borates," *Tetsu-to-Hagane* (*Journal Iron Steel Inst.* Japan), vol. 72, no. 10, pp. 1513-1520, 1986.

[3] K. Bisaka, M. O. Makwarela, and M. W. Erweel, "Solid-State Reduction of South African Manganese and Chromite Ores," in IMPC 2016, 2016, pp. 1-16.

[4] W. K. Lu, "Process of the production and refining of low-carbon DRI(direct reduced iron)," PCT Patent publication WO2012149635A1, 2012.

[5] A. Lekatou and D. Walker, "Effect of silica on the carbothermic reduction of chromite," *Ironmak. Steelmak.*, no. May, p. 133, 1997.

A person understanding this invention may now conceive of alternative structures and embodiments or variations of the above all of which are intended to fall within the scope of the invention as defined in the claims that follow.

We claim:

1. A method for direct reduction of chromite, said method comprising the steps of:

(a) reducing a mixture to form a solid reduction product;

(b) separating said solid reduction product into a metallic chromium alloy phase and a non-metallic phase, wherein said mixture comprises of a mixture of chromite particles, reductant particles, and a transport media, said transport media being cryolite particles.

2. The method according to claim 1, wherein said reductant particles are from a carbon source.

3. The method according to claim 2, wherein said carbon source is at least one of: coke, coal, graphite, and char.

4. The method according to claim 1, wherein said chromite is sourced from at least one of: chromite fines, chromite concentrates, chromite wastes, and chromite-containing slags.

5. The method according to claim 1, wherein an atmosphere of a furnace in which step a) is being executed is controlled by at least one of:

adjusting an air to fuel ratio of a burner in said furnace;

purging said furnace with reducing gas;

adding a carbonaceous adjusting agent to said mixture as a bed layer for a feedstock; and adding a carbonaceous adjusting agent to said mixture to cover feedstock to prevent further reduction.

6. The method according to claim 1, wherein a furnace in which step a) is executed operates at a temperature of at least 1200° C. and, at most, 1400° C.

7. The method according to claim 1, wherein a furnace in which step a) is executed operates at a temperature of 1300° C.

8. The method according to claim 1, further including a step of granulating said mixture before said mixture is reduced.

9. The method according to claim 8, wherein said step of granulating said mixture produces at least one of: pellets and briquettes.

10. The method according to claim 9, wherein granules resulting from said granulating have a diameter of at least 1 cm and, at most, 2 cm.

11. The method according to claim 1, further including a step of melting said reduction product.

12. The method according to claim 1, wherein said mixture has a chromite-carbon-cryolite weight ratio of at least 100:15:15 and, at most, 100:25:30.

13. The method according to claim 1, wherein a specified diameter of said chromite particles is, at most, 150 μm.

14. The method according to claim 13, wherein said specified diameter of said chromite particles is at least 53 μm and at most 74 μm.

15. The method according to claim 1, wherein a specified diameter of said reductant particles is, at most, 150 μm.

16. The method according to claim 15, wherein said specified diameter of said reductant particles is at least 38 μm and, at most, 106 μm.

17. The method according to claim 1, wherein said reducing step is executed for at least 2 hours.

18. The method according to claim 1, wherein said cryolite particles are from a group consisting of: synthetic cryolite, natural cryolite, and impure cryolite.

19. The method according to claim 1, wherein said transport media is a by-product of an aluminum smelting process.

20. The method according to claim 19, wherein the cryolite in said by-product has a molar ratio of $NaF/AlF_3$ of at least 1 and, at most, 7.

21. The method according to claim 1, wherein said transport media is waste from an aluminum smelting process.

22. The method according to claim 21, wherein the cryolite in said waste material has a molar ratio of $NaF/AlF_3$ of at least 1 and, at most, 7.

23. A method for direct reduction of chromite, said method comprising the steps of:

(a) mixing chromite particles, reductant particles, and a transport media, said transport media being cryolite particles, to form a mixture;

(b) reducing said mixture to form a solid reduction product;

(c) cooling said solid reduction product; and (d) separating said solid reduction product into a metallic chromium alloy phase and a non-metallic phase.

24. The method according to claim 23, further including a step of granulating said mixture before said mixture is reduced.

25. The method according to claim 23, further including a step of melting said solid reduction product.

26. A method for direct reduction of chromite, said method comprising the steps of:

(a) obtaining chromite particles;

(b) obtaining reductant particles;

(c) obtaining cryolite particles;

(d) mixing said chromite particles, said reductant particles, and said cryolite particles to form a mixture;

(e) reducing said mixture at a predetermined temperature for a predetermined time to form a solid reduction product;

(f) cooling said solid reduction product; and (g) separating said solid reduction product into a metallic chromium alloy phase and a non-metallic phase, wherein steps (a) to (c) may be performed in any order.

27. The method according to claim 26, further including a step of granulating said mixture before step e) is executed.

28. The method according to claim 26, further including a step of melting said solid reduction product.

* * * * *